US010384858B2

(12) United States Patent
Davideit et al.

(10) Patent No.: US 10,384,858 B2
(45) Date of Patent: Aug. 20, 2019

(54) DISPENSING VALVE INCORPORATING HIGH FLOW RATE FEATURE

(71) Applicant: SUMMIT PACKAGING SYSTEMS, INC., Manchester, NH (US)

(72) Inventors: Daniel E. Davideit, Manchester, NH (US); Kevin G. Verville, Deerfield, NH (US)

(73) Assignee: Summit Packaging Systems, Inc., Manchester, NH (US)

( * ) Notice: Subject to any disclaimer, the term of this patent is extended or adjusted under 35 U.S.C. 154(b) by 0 days.

(21) Appl. No.: 16/190,287

(22) Filed: Nov. 14, 2018

(65) Prior Publication Data

US 2019/0077585 A1 Mar. 14, 2019

Related U.S. Application Data

(63) Continuation of application No. 15/117,821, filed as application No. PCT/US2015/015799 on Feb. 13, 2015, now Pat. No. 10,138,050, which is a continuation-in-part of application No. 14/181,219, filed on Feb. 14, 2014, now Pat. No. 9,254,954, which is a continuation-in-part of application No. 12/859,078, filed on Aug. 18, 2010, now abandoned.

(51) Int. Cl.

| | |
|---|---|
| ***B65D 83/54*** | (2006.01) |
| ***B65D 83/48*** | (2006.01) |
| *B05B 1/30* | (2006.01) |
| *B65D 83/62* | (2006.01) |

(52) U.S. Cl.

CPC ..... *B65D 83/54* (2013.01); *B65D 83/48* (2013.01); *B65D 83/546* (2013.01); *B05B 1/3066* (2013.01); *B65D 83/62* (2013.01); *Y10T 29/49412* (2015.01)

(58) Field of Classification Search

CPC ..... B65D 83/54; B65D 83/48; B65D 83/62
USPC ..... 222/402.2, 402, 402.13
See application file for complete search history.

(56) References Cited

U.S. PATENT DOCUMENTS

| | | | |
|---|---|---|---|
| 529,221 | A | 11/1894 | Wagner |
| 2,686,652 | A | 8/1954 | Carlson et al. |
| 2,768,771 | A | 10/1956 | Beutel |

(Continued)

FOREIGN PATENT DOCUMENTS

| | | | |
|---|---|---|---|
| DE | 9000598 | U1 | 8/1990 |
| EP | 1 504 822 | A1 | 2/2005 |

OTHER PUBLICATIONS

International Search Report Corresponding to PCT/US2011/047908 dated Dec. 28, 2011.

(Continued)

*Primary Examiner* — Jeremy Carroll
(74) *Attorney, Agent, or Firm* — Davis & Bujold PLLC; Michael J. Bujold

(57) ABSTRACT

A high flow valve for use in conjunction with a compressed gas, an aerosol or in bag-on-valve applications, and particularly to a valve having a housing that is supported by a mounting cup for a product container or can, and communicates with a product or product containment bag inside the can. A radial opening or orifice of the valve is positioned closer to a lower seal of the valve stem, rather than an upper seal or mounting cup gasket, to facilitate an increased flow rate for dispensing the product from the container and the valve.

11 Claims, 20 Drawing Sheets

(56) References Cited

U.S. PATENT DOCUMENTS

| | | | | | |
|---|---|---|---|---|---|
| 3,186,605 | A | | 6/1965 | Potoczky | |
| 3,294,118 | A | | 12/1966 | Wieden et al. | |
| 3,658,215 | A | | 4/1972 | Ewald | |
| 3,709,410 | A | | 1/1973 | Cunningham | |
| 3,722,759 | A | * | 3/1973 | Rodden | B65D 83/48 137/529 |
| 3,865,313 | A | * | 2/1975 | Kondo | B05B 11/3039 222/321.2 |
| 3,893,653 | A | | 7/1975 | Kolanus | |
| 3,990,613 | A | | 11/1976 | Wray | |
| 3,997,086 | A | * | 12/1976 | Shay | B05B 11/3025 222/385 |
| 4,471,893 | A | | 9/1984 | Knickerbocker | |
| 4,475,667 | A | | 10/1984 | Ori et al. | |
| 5,018,647 | A | * | 5/1991 | Abplanalf | B65D 83/206 222/108 |
| 5,125,546 | A | | 6/1992 | Dunne et al. | |
| 5,597,095 | A | * | 1/1997 | Ferrara, Jr. | B65D 83/202 222/402.12 |
| 5,690,256 | A | * | 11/1997 | Smith | B65D 83/206 222/402.1 |
| 6,092,698 | A | | 7/2000 | Bayer | |
| 6,305,582 | B1 | | 10/2001 | Tsutsui et al. | |
| 6,478,198 | B2 | | 11/2002 | Haroian | |
| 6,588,628 | B2 | | 7/2003 | Abplanalp et al. | |
| 6,837,401 | B2 | | 1/2005 | Groys | |
| 2001/0002676 | A1 | | 6/2001 | Woods | |
| 2004/0124217 | A1 | | 7/2004 | Yquel et al. | |
| 2005/0121476 | A1 | | 6/2005 | Pauls et al. | |
| 2005/0145654 | A1 | | 7/2005 | Rackwitz | |
| 2007/0228086 | A1 | | 10/2007 | Delande et al. | |
| 2008/0290307 | A1 | | 11/2008 | Scheindel | |
| 2009/0294719 | A1 | * | 12/2009 | Jeske | B65D 83/48 251/333 |

OTHER PUBLICATIONS

Written Opinion Corresponding to PCT/US2011/047908 dated Dec. 28, 2011.

* cited by examiner

INITIALLY ACTUATED

NORMALLY CLOSED, UNACTUATED

CLOSED, UNACTUATED

OPEN, PRODUCT DOSED

CLOSED, PRODUCT PRIMING

CLOSED, PRODUCT DOSED

INITIALLY ACTUATED

NORMALLY CLOSED, UNACTUATED

CLOSED, UNACTUATED

OPEN, PRODUCT DOSED

CLOSED, PRODUCT PRIMING

CLOSED, PRODUCT DOSED

DISPENSING VALVE INCORPORATING HIGH FLOW RATE FEATURE

This application is a continuation of U.S. patent application Ser. No. 15/117,821, filed on Aug. 10, 2016, which is a National Stage completion of International Patent Application Serial No. PCT/US2015/015799, filed on Feb. 13, 2015, which is a continuation-in-part of U.S. patent application Ser. No. 14/181,219, filed on Feb. 14, 2014, which is a continuation-in-part of U.S. patent application Ser. No. 12/859,078, filed on Aug. 18, 2010.

FIELD OF THE INVENTION

The present invention relates to a metering valve that dispenses a pre-determined quantity of material from a container, under a dispensing pressure of an aerosol or compressed gas, that is simple in structure and readily manufactured. The present invention further relates to a high flow valve used in conjunction with a compressed gas, an aerosol or in bag-on-valve applications, and particularly to a valve having a housing that is supported by a mounting cup for a product container or can, and communicates with a product or product containment bag inside the can, where the radial opening of the valve is positioned closer to a lower seal of the valve stem rather than an upper seal or mounting cup gasket facilitating an increased flow rate for dispensing the product from the container and valve. The valve stem serves as a metering chamber with a metering device within the valve stem that seals the valve stem from the container in a pre-dispensing position and seals the exit orifice of the chamber after dispensing from the valve stem metering chamber the pre-determined quantity of material.

BACKGROUND OF THE INVENTION

Standard aerosol valve and gasket assemblies for dispensing pressurized product from a container have an inherent structural problem which limits the flow rate of product through the valve stem and out of the container. As is well known, the gasket which seals the conventional radial opening of the spring biased valve in the valve housing of conventional aerosol valves also seals the valve stem with the mounting cup of the container, limiting the diameter of the opening relative to the valve stem extending through the gasket. The valve stem is provided with both an axial and a radial opening for dispensing product from the container. When the valve stem is depressed inward or pushed down by a user against a spring bias, the radial opening, which is initially blocked by the gasket, is moved into fluid communication with the product contained in the container so that this product is then permitted to flow through the radial opening and out the valve stem and be discharged or dispensed into the environment. Once the user releases the valve stem, the valve stem is automatically returned back into its sealed, closed position with the mounting cup gasket again blocking the radial opening.

The structural problem is two-fold; first, the diameter of the radial opening formed in the sidewall of the valve stem must be smaller than the thickness of the gasket so that the radial opening is adequately covered and sealed in the closed valve position, otherwise there is a substantial risk of the product leaking or flowing into the radial opening and inadvertently able to escape the product contained even when the valve is closed. The thickness of a conventional gasket is typically in the range of 1.02 mm-1.52 mm (0.04-0.06 inches), so that the diameter of the radial opening must be substantially within this range or slightly smaller. This along with tolerances necessary to ensure complete closure of the valve limits the size of the radial opening. Secondly, the larger the radial opening formed in a side wall of an upper portion of the valve stem where it is typically located in such conventional valve stems, the greater the effect on the structural integrity of the valve stem. If the opening is too large, the valve stem, when subjected to axial and radial forces during depression by a user, can break, bend or otherwise permanently damage the valve stem or fail. Accordingly, it is difficult to obtain high flow rates of product due to such restrictions in the size of the radial opening in the stem. Further, highly viscous products, such as toothpaste and gels, cannot be dispensed without a sufficiently large passage being formed in the valve stem.

Similarly, in other applications such as bag-on-valve assemblies, such valve stem openings create the same or similar structural issues. Collapsible and highly flexible product bags or pouches have become common in different industries for containing a variety of food, beverages, personal care or household care or other similar products. Such product bags can be used alone to allow a user to manually squeeze and dispense a product from the bag or the product bag may be utilized in combination with a pressurized can and product, for example an aerosol. Such product bags and valves contained in and used with aerosol cans are generally referred to in the aerosol dispensing industry as bag-on-valve (BOV) technology. These product bags, valves and cans may be designed to receive and dispense a desired product in either a liquid or semi-liquid form which has a consistency so as to be able to be expelled from the valve or outlet by the user when desired.

Bag-on-valve technology is known to utilize a product dispenser, such as a can, which has an empty collapsible product bag inserted therein prior to filling of the bag with the desired product to be dispensed. The bag is initially flat and rolled up to form a smaller diameter so as to facilitate axial installation of the bag inside the can with a portion of a filling/dispensing valve communicating with an interior space of the product bag. During a final manufacturing phase, the product bag is filled with the desired product to be dispensed.

During the filling process, a desired product to be dispensed is inserted into the product bag via the two-way valve by conventional filling mechanisms. When the bag is filled by the filling mechanism, the product bag expands inside the can. At some point during the assembly process, the can is supplied with a pressurized gas, an aerosol or a compressed gas, in order to assist with squeezing the bag to expel the product contents thereof as is well known in the art. Many factors influence the expulsion of the contents or product to be dispensed from the can out of the valve into the environment. The valve is a key component, which led to the design of multiple valve configurations for a variety of different applications.

Typically, bag-on-valve applications use a valve that has two components, namely, a valve housing and a valve stem. For most applications, the valve housing engages with a mounting cup of a can, attaches to a bag that holds the product to be dispensed, and provides the framework for the valve stem. The valve stem usually interacts with the interior of the valve housing through the use of a spring. The spring allows the valve stem to move relative to the valve housing to open and close the valve. Typically, when the valve is opened, product to be dispensed flows from the product bag, to and through the valve housing, then through a passage in the valve stem, and finally the product is discharged, via a discharge nozzle of some sort, into the environment. The passage is normally limited in size and shape based on the sealing of the passage by the upper gasket that is used to seal the valve housing to the mounting cup.

One issue associated with the bag-on-valve technology is the control of the flow volume of the product contents from the bag for discharge into the environment. This issue is especially compounded due to the different viscosities of the various products which manufacturers desire to dispense from such bag-on-valve containers. The various product contents include, for example, liquids, creams, foams, gels, aerosols, colloids, and various other substances. Handling the flow of a highly viscous substance, such as toothpaste, is particularly difficult in both conventional and bag-on-valve applications where the aerosol dispensing radial openings or passages are particularly small, e.g., in the range of 1.02 mm-1.52 mm (0.04-0.06 in.) and there is no structural feasibility to make these radial openings or passages larger with conventional valve structures. The problem is to be able to accommodate larger dispensing openings in the valve greater than 1.02 mm-1.52 mm (0.04-0.06 in.) in order to accommodate more viscous product to be dispensed and at higher flow rates.

The present invention addresses the required increased flow rate necessary in some bag-on-valve applications. In some aerosol applications, however, the bag-on-valve containers may not be feasible due to volume constraints of the container and cost considerations, even though it may be undesirable to mix the propellant gas with the product material. In these instances, immiscible gases, such as nitrogen or carbon dioxide, may be preferred. The present invention provides for liquefied propellants or compressed gas, such as air, nitrogen or carbon dioxide, to be used and further may provide metered doses of product to be dispensed as required in some aerosol applications.

SUMMARY OF THE INVENTION

The present invention is directed to a valve used in both conventional and bag-on-valve aerosol container applications that allows a high flow rate of various products, especially viscous substances. According to a first embodiment of the present invention, the valve includes a valve housing, a valve stem, and a spring or other biasing element that permits the valve stem to move relative to the valve housing. The valve stem is substantially hollow to allow the flow of product to the bag, during the filling process, and to the product to be dispensed from the bag during use. The bag is attached to the valve housing in a conventional fashion. There is a radial bore or bores and a seal near the bottom of the valve stem that dictate the passage and flow rate of pressurized product to be dispensed between the product container and the environment. The radial bore at the bottom or lower portion of the valve stem provides for flow directly from the product reservoir, defined by the bag, to the valve stem passage when a lower seal on the valve is opened. The valve stem passage is sealed by the lower seal or ring which is a separate sealing gasket or ring from the upper gasket. The lower seal may be located anywhere along the valve stem below the upper gasket and preferably at the bottom or lower portion of the valve stem facilitating communication to the product reservoir.

As a reference point, the upper portion of the valve stem and upper gasket both refer to the end of the valve stem and the gasket adjacent the orifice in the mounting cup. The lower portion of the valve stem and the lower gasket or ring are spaced from and located axially below the upper portion and generally more interior of the container so that product ejected from the container when the valve is actuated travels from the lower portion of the valve stem past the lower gasket or ring up through the upper portion of the valve stem and out of the valve.

The addition of a lower sealing gasket or ring allows one or more larger diameter bore(s) to be radially formed in the lower portion of the valve stem without compromising the integrity of the valve stem itself. The bore shape and larger size can be selected to facilitate a high volume flow rate for highly viscous substances. For example, a triangular or polygonal shape bore could provide a variable flow rate into and through the valve stem to ensure that highly viscous materials are dispensed at a desired flow rate, depending on an actuation pressure of a user. It is, therefore, an object of the present invention to overcome the above noted issues and produce a valve for both conventional aerosol valve and bag-on-valve systems which facilitates a high volume flow rate for liquids and semi-liquids of different viscosities.

In a further embodiment, a metering device such as a metal, ceramic or plastic ball is positioned within the valve stem to provide for dispensing a metered dose of product to be dispensed. The use of a metering device within a metering chamber is well known, with many aerosol valve designs of the prior art showing elaborate, costly and difficult to manufacture mechanisms having one or more mechanical springs, plungers, and other contrivances within the metering chamber to control the movement and positioning of the metering device. What is not shown in the prior art is the placement of the metering device within the valve stem.

In the present invention, the location of the sealing ring at the base of the valve stem provides for radial inlet passages to be positioned below a lower sealing rim that using the metering device seals the pre-determined quantity of product within the valve stem from the product within the container. Because the metering device is within the valve stem, a propellant such as a compressed gas within the container can be used because the propellant acts directly on the metering device to force the metering device through the valve stem and dispense the pre-determined quantity of product to be dispensed. By acting directly on the metering device, a common problem of using compressed or immiscible gas is alleviated, where the compressed gas is not valved off in a metering chamber and therefore left without means to dispel it therefrom. In the present invention, the propellant acts directly on the metering device to dispense the pre-determined quantity that is defined by the volume of the valve stem. This volume may therefore be adjusted by changing the length and diameter of the valve stem, which as a single piece may be interchangeable and be easily replaced in the valve housing to provide for larger or smaller required dosage volumes for specific products and applications.

The valve stem is initially filled with product to be dispensed through a priming actuation by fully or partially compressing the valve stem. Once primed, by compressing the valve stem, the propellant which may be a compressed gas, forces the ball as a metering device off of a lower sealing rim to travel up and through the valve stem thereby dispensing the quantity of product to be dispensed within the valve stem. The ball engages an upper sealing rim at the outlet orifice of the valve stem to seal and prevent further product from being dispensed to the inlet passage of the actuator and nozzle. As the actuator is released, delivery of the product to be dispensed through the nozzle stops and the ball returns downward to a rest position on the lower sealing rim. The valve stem as the metering chamber is therefore filled with the pre-determined quantity of product for dispensing another metered dose. A small conduit may be provided at the upper sealing rim. The conduit provides communication between the valve stem and air external to the aerosol container in order to provide a pressure differential on each side of ball to release the ball from the upper sealing position after the valve is released. It is therefore an object of the invention to provide for a metering device within the valve stem to simplify the assembly and cost of a metering valve.

It is another object of the present invention to provide a valve stem that serves as a metering chamber with a metering device to dispense pre-determined quantities of product to be dispensed based on the volume of the valve stem.

It is another object of the present invention to provide radial passages to a valve stem positioned below a lower sealing rim within the valve stem.

It is another object of the present invention to provide a metering valve capable of dispensing pre-determined quantities of product to be dispensed using liquefied propellants or compressed air within an aerosol container.

It is another object of the present invention to easily facilitate varying flow rates based on the point of depression of the valve.

It is a still further object of the present invention to provide a high volume flow rate for highly viscous substances that typically have difficulty being dispensed.

It is yet another object of the present invention to simplify the process of adding and discharging the contents of the aerosol can, container or product bag by allowing the product to be dispensed to go directly from the valve stem into the container or product bag without having to pass through the valve housing.

Another object of the present invention is to provide a two-way valve which permits a substantial increase in the speed of filling a product container or bag, especially in the context of highly viscous substances.

The present invention relates to a valve for use in a pressurized aerosol application, the valve comprising a valve housing having an outer surface for supportive engagement with a mounting cup for a product container; a first cavity defined within the valve housing for receiving valve components. The valve components may include: a valve stem springingly engaged with the valve housing; the valve stem defining a central passage for dispensing pressurized product to be dispensed to the environment; a lower end portion including a sealing ring for engaging a sealing edge of the valve housing; and at least one radial bore formed in a sidewall of the valve stem located in the lower end portion of the valve stem. The at least one radial bore may lead to the central passage extending from the radial bore to a dispensing orifice at an upper end portion of the valve stem.

The present invention also relates to an actuator for an aerosol container comprising a valve housing defining a cavity for receiving valve components. The valve components may include: an upper portion for engaging a mounting cup for an aerosol container, a chamber for containing a spring, and a lower sealing edge defining an opening into the valve housing. An inner seal exists between the upper portion of the valve housing and the mounting cup. A valve stem is supported within the valve housing and axially movable relative thereto in accordance with the spring; the valve stem having a passage extending between a radial opening at a lower end of the valve stem and an axial opening at an upper end of the valve stem; and receiving a lower seal supported on the valve stem between the radial opening and a lowermost end of the valve stem.

The present invention also relates to a method of making an actuator for dispensing product from an aerosol container through the actuator comprising the steps of providing a valve housing defining a cavity for receiving valve components. The method also includes the steps of engaging an upper portion of the valve housing in a mounting cup of the aerosol container, forming a chamber for containing a spring, and placing a lower sealing edge defining an opening into the valve housing. An inner seal is provided between the upper portion of the valve housing and the mounting cup. A valve stem is supported within the valve housing and axially movable relative thereto in accordance with the spring. The support of the valve stem having the additional steps of: extending a passage between a radial opening at a lower end of the valve stem and an axial opening at an upper end of the valve stem; and placing a lower seal on the valve stem between the radial opening and a lowermost end of the valve stem.

The present invention further relates to a metering valve for use in a pressurized aerosol application. The valve comprising a valve housing having an outer surface for supportive engagement with a mounting cup for a product container and a first cavity defined within the valve housing for receiving valve components. The valve components including: a valve stem springingly engaged with the valve housing. The valve stem defining a central passage for dispensing pressurized product to be dispensed to the environment. The valve stem comprising a metering device, an upper and lower sealing rim, and a lower end portion. The valve stem further comprising a sealing ring for engaging a sealing edge of the valve housing, and at least one radial bore formed in a sidewall of the valve stem located in the lower end portion of the valve stem below the lower sealing rim. The at least one radial bore leading to the central passage extending from the radial bore to a dispensing orifice positioned above the upper sealing rim at an upper end portion of the valve stem. Wherein the metering device is longitudinally movable within the valve stem from a rest position to an actuated position. The rest position sealing the valve stem from the container at the lower sealing rim. The actuated position dispensing a pre-determined quantity of product to be dispensed from the valve stem and then sealing the dispensing orifice at the upper sealing rim of the valve stem. The propellant within the container of the pressurized product to be dispensed acts directly on the metering device of the metering valve to dispense the pre-determined quantity of product to be dispensed.

The propellant may be compressed gas such as an immiscible gas. The metering valve further comprises at least one micro-vent at least partially formed in the upper sealing rim of the valve stem to communicate externally to the container. The upper sealing rim of the valve stem of the metering valve is circumferentially tapered and the dispensing orifice is of a smaller diameter than the metering device. The metering valve further includes a first radial bore and a second radial bore located in the lower end portion of the valve stem below the lower sealing rim, and the first bore is located circumferentially opposite the second bore in the valve stem. Further, the lower sealing rim of the valve stem is circumferentially tapered from a diameter of the valve stem to the central passage extending from the radial bore and the sealing edge of the valve housing may comprise a concave curvature to accept and seal against the sealing ring. The metering device may be a ball of a stainless steel, ceramic or plastic material. In an embodiment a dip tube may be affixed to the valve housing. The metering valve may further have at least one bore in the valve stem that axially decreases in a cross-sectional area along the valve stem or at least one bore in the valve stem that axially increases in the cross-sectional area along the valve stem to change the flow of product through the valve stem.

The present invention is further related to an actuator for dispensing a pre-determined quantity of product to be dispensed from an aerosol container comprising a valve housing defining a cavity for receiving valve components. The valve components including: an upper portion for engaging a mounting cup for an aerosol container, a chamber for containing a spring, and a lower sealing edge defining an opening into the valve housing. An inner seal between the upper portion of the valve housing and the mounting cup. A valve stem supported within the valve housing and axially movable relative thereto in accordance with the spring. The valve stem having: a metering ball, an upper sealing rim at an axial opening at an upper end of the valve stem, a lower sealing rim at a lower end of the valve stem, a radial opening positioned below the lower sealing rim, and a lower seal supported on the valve stem between the radial opening and a lowermost end of the valve stem. Wherein the metering device seals against the lower sealing rim in a closed position of the actuator and seals against the upper sealing rim in an open position of the actuator thereby dispensing a pre-determined quantity of product to be dispensed from the aerosol container.

The actuator for an aerosol container may further comprise: in the unactuated position, the valve housing engaged with the sealing ring, and in an actuated position, the valve housing spaced from the sealing ring. Wherein product to be dispensed in the container can communicate with the radial opening of the valve stem. In an actuated position propellant acts directly on and displaces the metering ball from the lower sealing rim filling the valve stem with product to be dispensed until the metering ball seals against the upper sealing rim. The valve stem of the actuator for an aerosol container may in a fully or partially actuated position prime the metering valve.

The present invention is further related to a method of making an actuator for dispensing a pre-determined quantity of product to be dispensed from an aerosol container comprising the steps of providing a valve housing defining a cavity for receiving valve components. Further comprising the steps of engaging an upper portion of the valve housing in a mounting cup of the aerosol container, forming a chamber for containing a spring, and placing a lower sealing edge defining an opening into the valve housing. Providing an inner seal between the upper portion of the valve housing and the mounting cup, supporting a valve stem within the valve housing. The valve stem being axially movable relative thereto in accordance with the spring. The forming of the valve stem comprising the steps of: locating a metering device within the valve stem, forming an upper sealing rim at the outlet orifice of the valve stem, forming a lower sealing rim at the lower end of the valve stem, extending a radial passage at a lower end of the valve stem below the lower sealing rim to communicate through the valve stem with the outlet orifice, and placing a lower seal on the valve stem between the radial opening and a lowermost end of the valve stem.

The method of dispensing a pre-determined quantity of product to be dispensed from an aerosol container may further comprise the steps of defining an unactuated position by engaging the lower seal on the valve stem to the lower sealing edge of the valve housing and sealing the metering device against the lower sealing rim. Defining an actuated position by compressing the valve stem and thereby spacing the lower seal from the lower sealing edge of the valve housing. Thereby delivering product to be dispensed in the container through the radial opening to the valve stem by displacing the metering device from the lower sealing rim. The propellant of the container acting directly on the metering device to force the pre-determined quantity of product to be dispensed from the valve stem through the outlet orifice to a point of sealing the metering device against the upper sealing rim. Defining a partially actuated position by releasing the valve stem from compression and delivering external air from a conduit to release the metering device from sealing against the upper sealing rim. The method of dispensing product to be dispensed from an aerosol container by having propellant acting directly on the metering device and the propellant may be an immiscible gas. The method of dispensing product to be dispensed from an aerosol container may further comprise the steps of forming separated first and second radial openings in a sidewall of the valve stem.

These and other features, advantages and improvements according to this invention will be better understood by reference to the following detailed description and accompanying drawings.

DETAILED DESCRIPTION OF THE PREFERRED EMBODIMENTS

Figure 1:
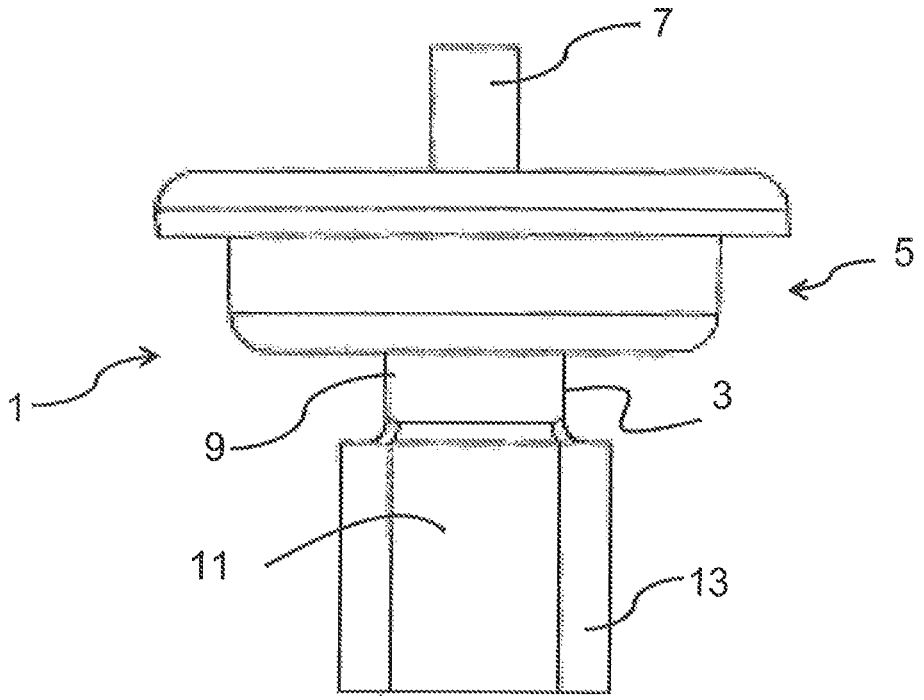
FIG. 1 is a side elevation view of a valve of a first embodiment of the present invention in conjunction with a mounting cup.

FIG. 1 illustrates a side view of an embodiment of the present invention depicting the valve 1 in conjunction with the mounting cup 5 for a product containing can or container (not shown) in a bag-on-valve system. The valve stem 7 is arranged parallel to and extends out of the valve housing 3 and through the mounting cup 5. The valve housing 3 has multiple sections or portions that correspond to different functions for the bag-on-valve application. A top portion of the valve housing is engaged with the mounting cup, by crimping, to secure the valve housing 3 to the mounting cup 5. The middle portion of the valve housing 3 accommodates a spring cavity 9, which generally houses a spring for controlling dynamic movement between the valve stem 7 and the valve housing 3. The spring normally biases the valve stem 7 away from a bottom portion 11 of the valve housing 3 into a closed position which prevents the discharge of product from the container. The bottom portion 11 of the valve housing 3 either engages with a dip tube, or as described in the first embodiment, with a product bag in the case of a bag-on-valve. According to the present embodiment, a top edge of the product bag (not shown) engages and seals with the bottom portion 11, along a fitment 13, and the valve 1 is utilized to dispense the contents or product to be dispensed from the bag. It is to be appreciated that the valve 1 can be a two-way valve which would allow for product to be dispensed to be inserted into the bag during a filling process as well as dispensed therefrom.

Figure 2:
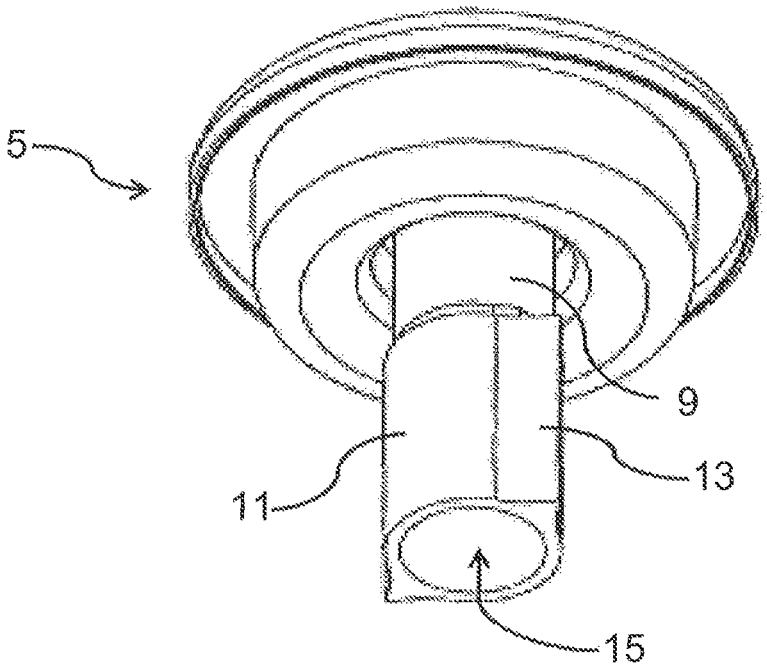
FIG. 2 is a perspective view of a first embodiment of the present invention in conjunction with a mounting cup.

The bottom portion 11 is better illustrated in the perspective view of FIG. 2. The fitment 13 on the bottom portion 11 assists in the sealing engagement between the base or bottom portion of the valve housing 3 and the product bag B is more fully described in U.S. patent application Ser. No. 12/667,423; the subject matter of which is herein incorporated by reference. This view also shows the entrance to cavity 15 of the valve housing 3 that receives the product to be dispensed from the bag when a user manipulates or operates the valve into an open position to dispense the product. The entrance to cavity 15 may or may not communicate with a dip tube 16 which extends downward into the lower edges and corners of the bag to facilitate complete product dispensing.

Figure 3:
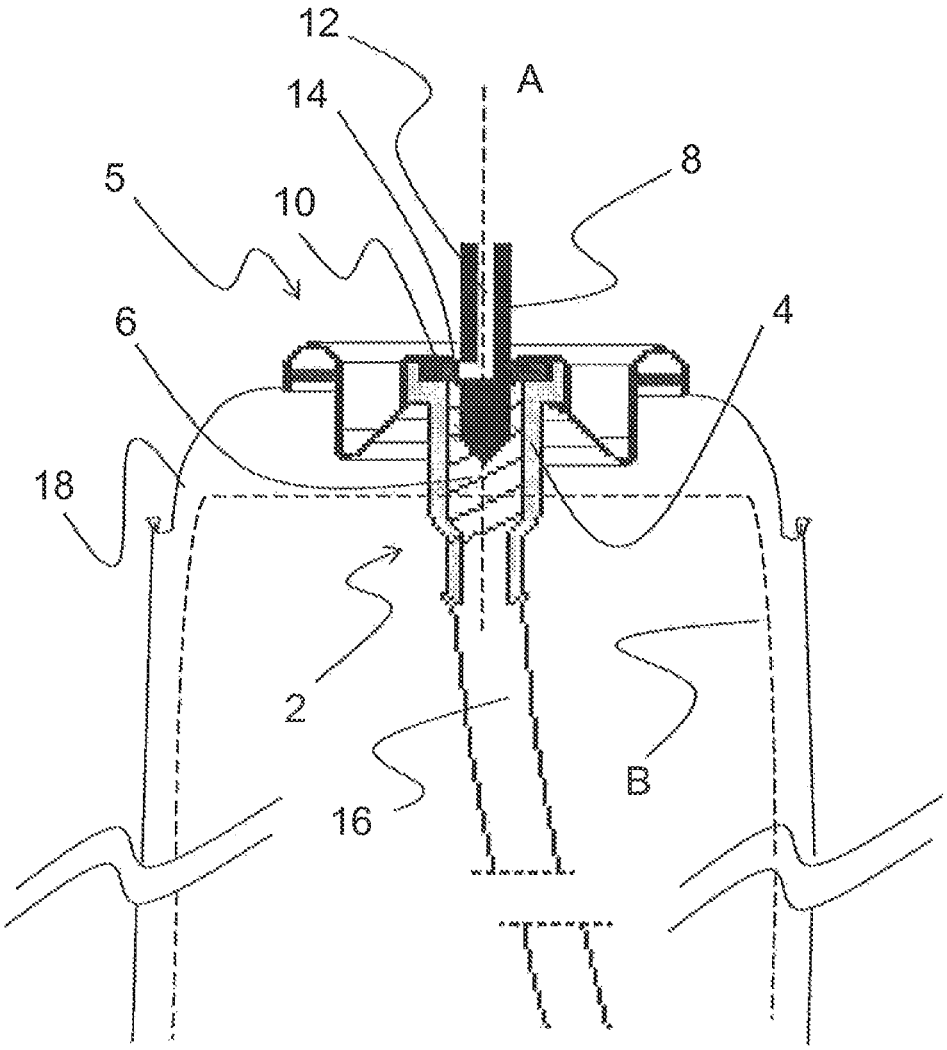
FIG. 3 (PRIOR ART)
FIG. 3 is a cross-sectional view of a valve of the prior art.

A cross-sectional view of a conventional valve 2, according to the prior art, is shown FIG. 3. The valve 2 is secured to a mounting cup 5 and has a valve stem 8, a valve housing 4, a valve spring 6 and valve gasket 10. The valve 2 is actuated by depressing the valve stem 8 along axis A to a point below the seal of the gasket 10, against a restoring force supplied by the valve spring 6, so that product to be dispensed may commence flowing from the bag B through the product passage 12 and out from the valve container. The gasket 10 also seals the valve housing 4 to the mounting cup 5 to prevent leakage therebetween. The bag B is within the aerosol container 18. As noted above, the spring 6 normally biases the valve 2 in a normally closed position, as shown, with the opening to the product passage 14 being sealed by and against the gasket 10. According to the prior art, the product to be dispensed flows along the valve housing 4, up and around the valve stem 8 and into the product passage 12. The valve 2 may or may not include a dip tube 16 to assist with dispensing product from the bag B.

Figure 3A:
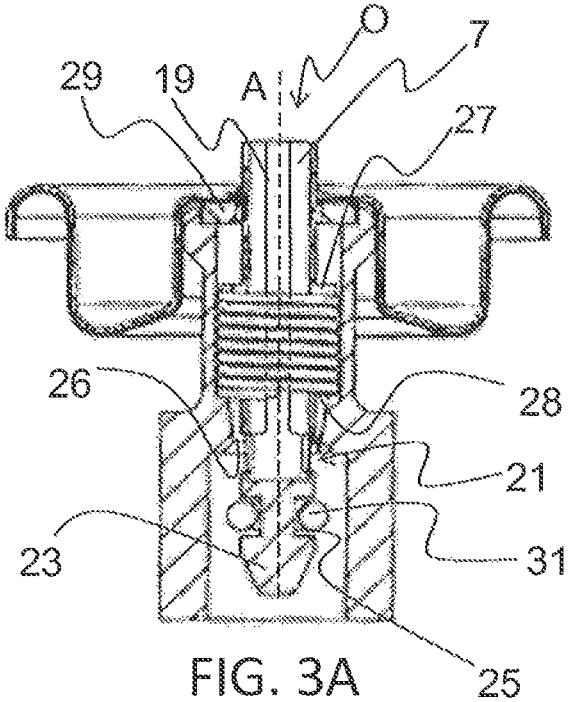
FIG. 3A is a cross-sectional view of a first embodiment of the present invention in conjunction with a mounting cup illustrating a semi-opened position.
Figure 3B:
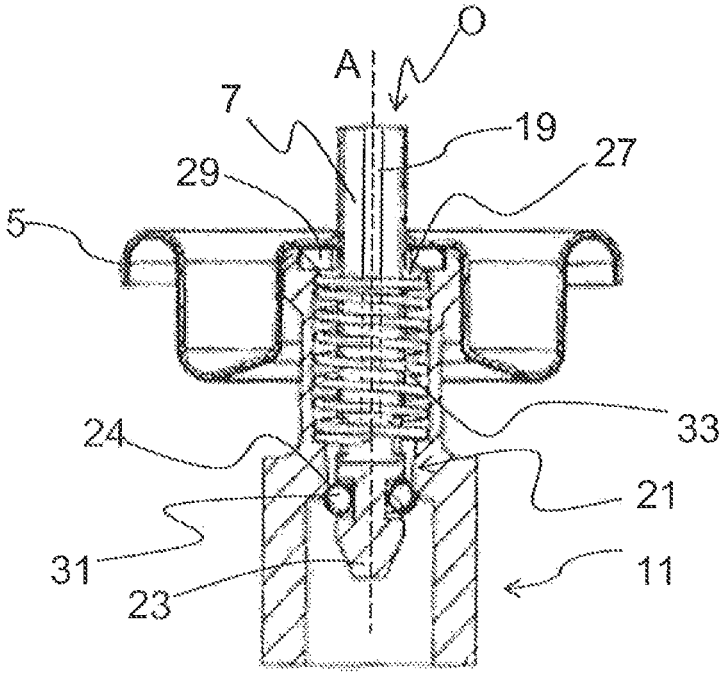
FIG. 3B is a cross-sectional view of a first embodiment of the present invention in conjunction with a mounting cup illustrating a fully closed position.

FIGS. 3A and 3B are cross-sectional views of the bag-on-valve embodiment which show the valve housing 3 engaged with the mounting cup 5. An inner gasket 29 is used to form a seal between the valve housing cavity 15, the valve stem 7 and the mounting cup 5. The valve stem 7 extends through the mounting cup 5 and out of the valve housing 3 and is axially biased into a closed position by spring 33. The valve stem 7 is provided with an end sealing portion 23 and a product entrance orifice(s) 21 located adjacent the end sealing portion 23 of the valve stem 7. The valve stem 7 is axially disposed along axis A through the valve and can be made of for example PET, PTFE or other polymer material well known in the art.

The valve stem 7 defines a product passage 19 that extends substantially the entire length of the valve stem 7. The product passage 19 commences at a radial bore(s) 21 which is formed adjacent a lower end of the valve stem 7. As described in detail below, positioning of the radial bore(s) 21 near the lower end of the valve stem 7 permits a larger bore opening which permits a greater flow of the product content from the bag B and into the product passage 19 and out of the valve stem 7, in comparison to conventional valves, without unduly compromising the integrity of the valve stem 7.

By depressing the valve stem 7 along the axis A, the valve is opened, as shown in FIG. 3A, and product is permitted to flow and is dispensed through a main opening O located at the uppermost end of the valve stem 7. A conventional nozzle, or some other conventional discharge or dispensing device, may be supported by the valve stem 7 and communicate with the main opening O for directing or controlling discharge of the product. At the opposing lower end of the valve stem 7, the end sealing portion 23 has a circumferential notch or channel 25 adjacent the tip 23 that receives a lower sealing ring 31, gasket, o-ring or some other type of seal including an overmolded seal. The valve housing 3 is formed with a respective ledge 26 on an inner wall to provide a sealing edge 24 against which the sealing ring 31 abuts to facilitate closing of the valve and preventing the flow of product to be dispensed from the product bag B while the valve is in a closed position, as shown in FIG. 3B.

The valve stem 7 is accommodated within the valve housing 3 and biased into the closed position via the spring 33, or some another biasing device, which forces the valve stem 7 axially upward against the gasket and into the closed position with the sealing ring 31 closing the valve against the sealing edge 24. It is to be appreciated that although there is no radial opening or bore in the region of the inner gasket 29, the inner gasket 29 still provides a seal between the valve housing 3, the sliding valve stem 7 and the mounting cup 5 so as to prevent any leakage. The spring 33 maintains the valve stem 7 in the closed position so that the product in the product bag B cannot flow through the valve 1 and be discharged. The spring 33 has an upper end which typically axially engages the valve stem 7 at a lip or stop 27 that extends partially or completely around an outer wall of the valve stem 7. The lower end of the spring 33 is supported by the valve housing 3 at a circumferential edge 28 around the interior wall of the spring cavity 9. The bias provided by the spring 33 allows depression and movement of the valve stem 7 relative to the valve housing 3 so as to enable the valve 1 to be alternately moved between its opened and closed positions, as shown in FIGS. 3A and 3B, respectively.

When the valve is in the open position shown in FIG. 3A, the product to be dispensed is permitted to flow out of the valve and into the environment. The product contents are able to flow from the product bag or container, in through the radial bores 21, along the valve stem 7 and out of the valve 1. The radial bores 21 are located at the lower end of the valve stem 7 adjacent the end sealing portion 23 of the valve stem 7. Although the drawings show two opposed radial bores 21, alternatively the valve stem 7 could have only one or more than two radial bore(s), either opposed or adjacent one another. The radial bores 21 are located immediately axially adjacent the lower sealing ring 31 and the end sealing portion 23 to allow substantially instantaneous flow of the product from the product reservoir through the valve stem 7 and subsequently discharged into the environment without having an intermediary chamber or circuitous flow path through the valve housing. Product ejection occurs when the valve stem 7 is depressed by a user into the open position, moving the valve stem 7 down relative to the valve housing 3 against the bias provided by the spring 33 thereby forcing the lower sealing ring 31 sufficiently away the ledge 26 so as to expose and facilitate direct communication and the radial bore(s) 21 and the fluid contents of either the bag B or the container.

As noted above, FIG. 3A illustrates the open position of the valve 1 that allows the radial bores 21 to communicate directly with a pressurized flow of the product to be dispensed from the product reservoir. Previous valves have been known to locate such bores or openings at or near the upper portion of the valve stem, which limits the size of the passageway due to the inability to effectively shut off flow through a large passage. According to the present invention, flow of the product to be dispensed is interrupted by the lower sealing ring 31, which allows the passages or bores 21 to be significantly larger than passages in previous valves that are positioned near the upper portion of the stem, as opposed to near the lower sealing ring 31. The larger sized radial bores 21, which can be formed greater than 1.02 mm-1.52 mm (0.04-0.06 in.) in diameter, are formed closer to the lower sealing ring 31 and allow for a higher volume flow rate of product out of the product reservoir to the environment. As can be seen in the FIGS. 3A and 3B, the bores 21, have a significantly larger diameter than the thickness of the upper inner gasket 29. Because of this significantly larger diameter, relative to known smaller diameters of radial openings adjacent the inner gasket 29, the present invention permits a substantially larger flow rate of product to be dispensed to flow into the valve passage 19, when the valve stem 7 is in a semi or fully open position.

Figure 4:
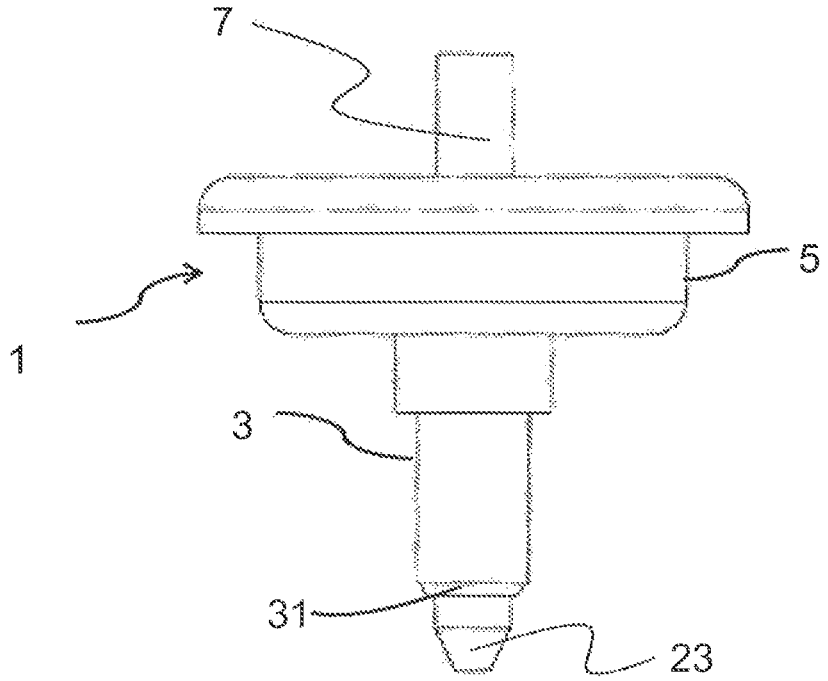
FIG. 4 is a side view of a second embodiment of the present invention in conjunction with a mounting cup illustrating a valve with the valve body tip extending beyond the valve housing.
Figure 5A:
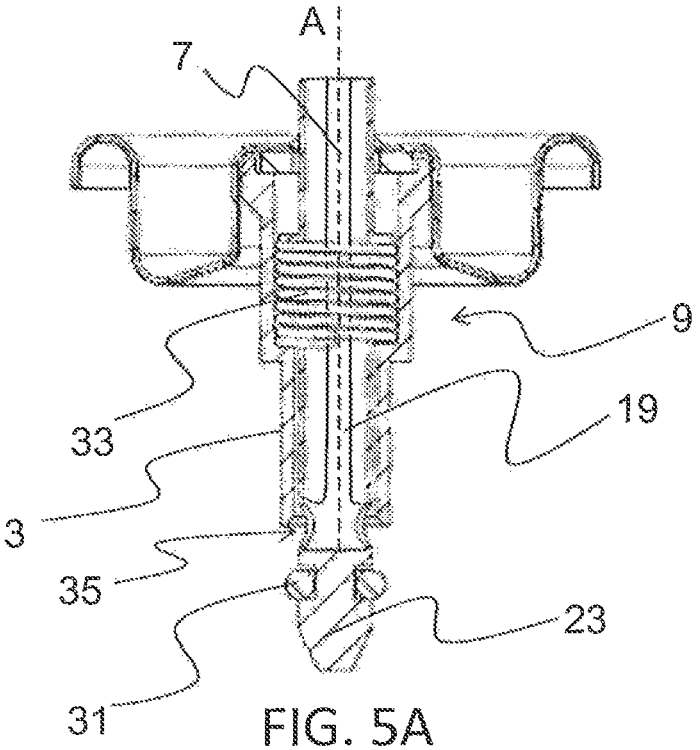
FIG. 5A is a cross-sectional view of a second embodiment of the present invention in conjunction with a mounting cup illustrating a semi-opened position.
Figure 5B:
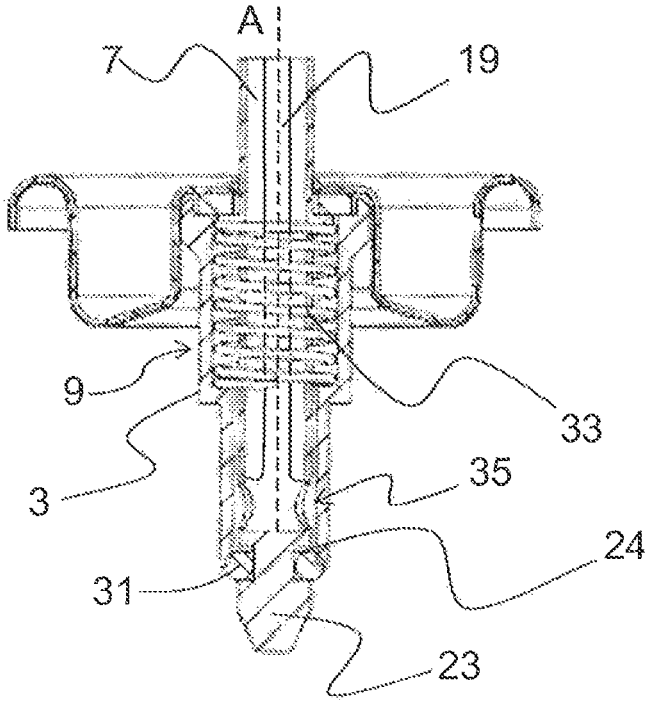
FIG. 5B is a cross-sectional view of a second embodiment of the present invention in conjunction with a mounting cup illustrating a fully closed position.

With reference now to FIGS. 4, 5A, and 5B, a second embodiment of the present invention is discussed. It is noted that this second embodiment is not a bag-on-valve embodiment such that the fitment for a B-O-V valve is not used and the end sealing portion 23 extends directly into an aerosol container with pressurized fluid product (not shown). It is to be appreciated that a dip tube 16 could also be attached to the end of the valve housing 3 for conventional style aerosol container, as desired or necessary. FIG. 5A shows the second embodiment in an open position allowing the product to be dispensed in the product bag to communicate with the valve stem 7 through the bores 35. FIG. 5B shows the valve of the second embodiment in a fully closed position with the lower sealing ring 31 preventing the flow of the product to be dispensed into the valve stem 7. The bores 35 in this embodiment are shown having a circular profile as opposed to the straight or rectangular profile shown in FIGS. 3A and 3B.

Another important aspect of the present invention is the shape of the bores 35 which can facilitate control over dispensing of product at a high flow rate through the valve.

Figure 6:
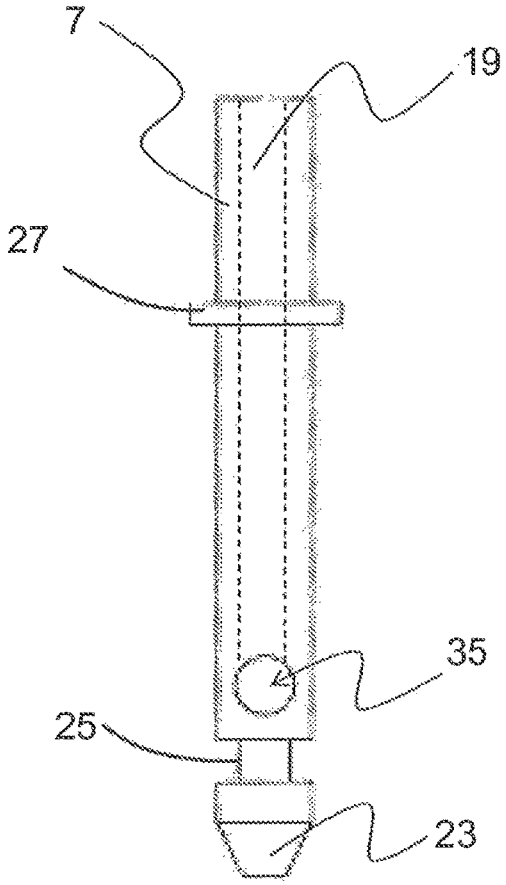
FIG. 6 is a side view of the valve body of the second embodiment of the present invention.

FIG. 6 illustrates a side view of the valve stem 7 of the second embodiment with the bore 35 having a substantially circular shape. The bore 35 is a radial orifice in the sidewall of the valve stem 7, and adjacent the lower end thereof, which can have a diameter of between about 1.02 mm-3.81 mm (0.04-0.15 inches) and more preferably in the range of about 2.03 mm-3.05 mm (0.08-0.12 inches). It is to be appreciated that the larger bores 35 do not significantly affect the structural integrity of the valve stem 7 since the bores 35 are located close to the bottom end of the valve stem 7 where radial forces from depression and actuation of the valve stem 7 by a user are insignificant. That is, the bores 35 are located vertically below the spring 33. It is to be appreciated that axial forces can significantly damage the valve stem where the radial opening is located closer to the top end of the valve stem 7 which the user pushes adjacent the inner gasket 29 as in the known valves. The larger bores 35 permit a high amount of product volume to flow into and through the passage 19 of the valve stem 7 at a high flow rate and eventually be discharged into the environment.

Figure 7:
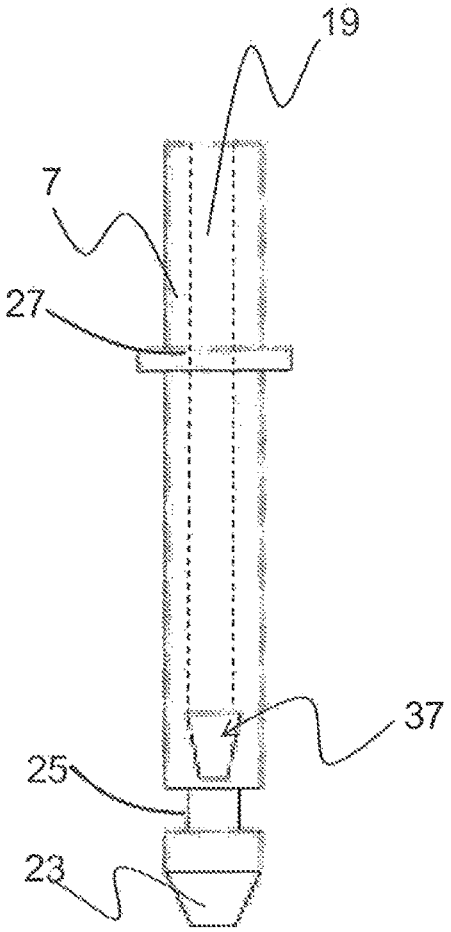
FIG. 7 is a side view of the valve body with an exemplary bore.

The radial bores or passages can be formed in any desired shape or size which facilitates the desired flow rate of the product. According to another embodiment of the present invention, the bores are designed to have a profile and area so that, depending upon how far the valve stem 7 is depressed relative to the sealing edge 24, a desired variable flow rate can be achieved which depends upon the extent that the bore 35 is exposed. Different shapes and sizes may be used for different products to achieve the desired product discharge results. For example, as shown in FIG. 7, the valve stem 7 may have a radial bore 37 which is shaped as a polygon that gradually increases in area as the valve stem 7 and bore 37 are gradually moved axially relative to the sealing edge 24 of the valve housing 3. In the case of the polygon shown in FIG. 7, as the valve stem 7 is depressed axially downward relative to the sealing edge 24, a larger cross-sectional area of the polygon bore 37 becomes progressively exposed to the product to be dispensed in the container and thus permits an increase in relative product flow the more the valve stem 7 is depressed. The polygon and circular bores shown in these figures are merely two examples of the type of larger bore shapes, located near or adjacent the bottom end of the valve stem 7, that can readily facilitate dispensing of a larger volume of the product to be dispensed at increased flow rates.

Figure 8:
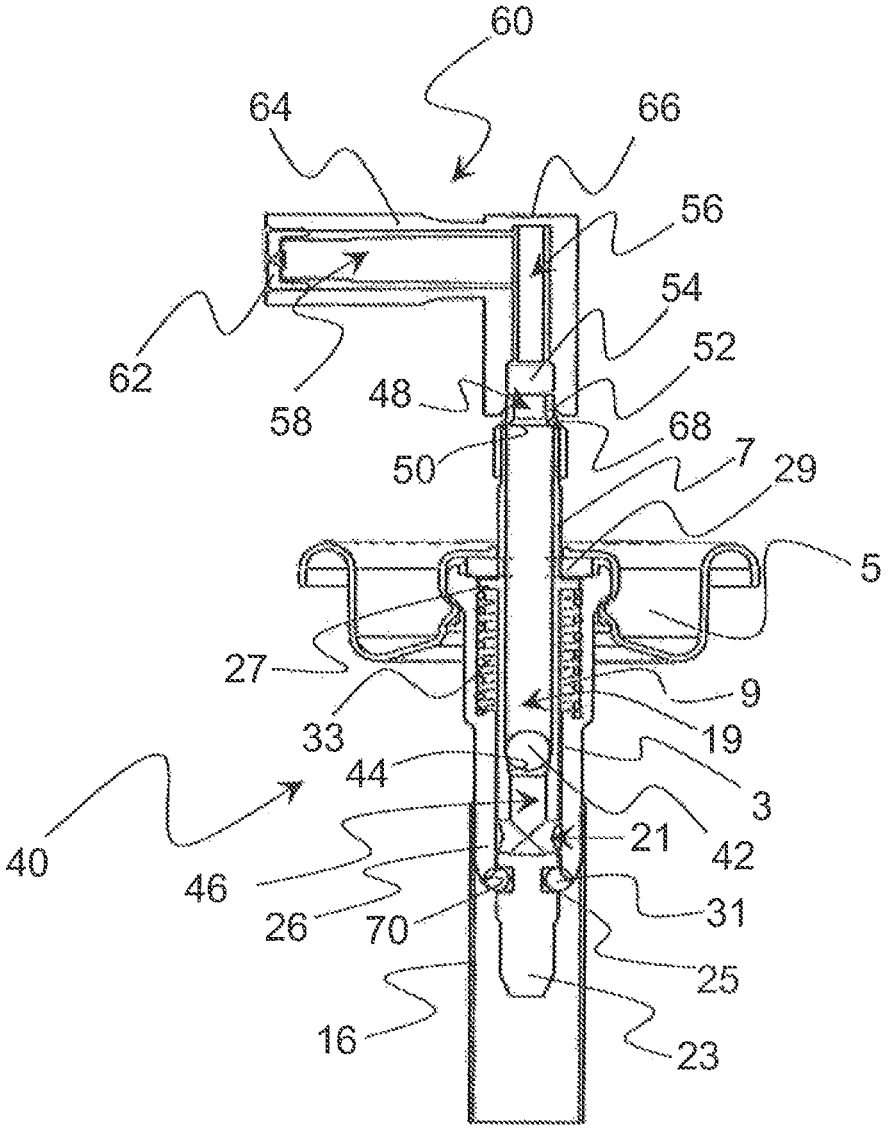
FIG. 8 is a diagrammatic cross sectional view of a third embodiment of the metering valve in a normally closed, unactuated position.

With reference now to FIG. 8, a metering valve 40, according to a further embodiment of the present invention, will now be described in detail. As generally shown, the metering device comprises a movable ball 42, or possibly a slidable piston or some other member, located within the valve stem 7. The metering valve 40 includes a conical or tapered lower ball seat or sealing rim 44 which tapers from the slightly larger diameter of the metering chamber 19 to a slightly smaller diameter of an axial inlet passage 46 that communicates with the radial bores 21 for delivering product to be dispensed from the container to the valve stem 7. In addition, the valve stem 7 also has a conical or tapered upper ball seat or sealing rim 50, located adjacent the outlet orifice 48, and the outlet orifice 48 has a slightly smaller diameter than a diameter of the metering chamber 19. The metering ball 42 has a slightly smaller diameter than the diameter of the metering chamber 19 so as to permit the metering ball to dispense a pre-determined quantity of product to be dispensed, while also facilitating return of the metering ball 42, as discussed below in further detail.

A conventional coupling 52, or some other fitting, facilitates coupling/interconnection of an inlet passage 74 of an actuator 60 to the free upper end of the valve stem 7. Typically, the vertically upper most portion of the valve stem 7 is matingly received by a first end of the conventional coupling 52 while the opposite vertically upper most end of the conventional coupling 52 is received by a lower inlet passage 74 of the actuator 60. In this way, the outlet orifice 48, of the valve stem 7, is axially aligned with a vertical first passage 56 formed in the actuator 60. The product to be dispensed may be dispensed from the actuator 60 either radially, as shown, via a substantially horizontal second passageway 58 or substantially vertically (not shown) via a second passageway 58. The substantially horizontal second passageway 58 connects the first passage 56 with a discharge nozzle 62 of the actuator 60 and facilitates dispensing of the product as an aerosol mist, for example. The substantially vertical second passageway 58, on the other hand, is substantially vertically aligned with, or a continuation of, the first passage 56. An actuation or depression area 66 may be provided along a top surface of the actuator housing 64 in order to facilitate depression of both the actuator 60 and the valve stem 7 and actuation of the metered valve 40.

An inwardly facing surface of both the upper ball seat or sealing rim 50 and the conventional coupling 52 is typically provided with one, and possibly more, micro groove(s), channel(s) or vent(s) 68. These micro groove(s), channel(s) or vent(s) 68 extend along the entire length of the conventional coupling 52 and at least a portion of the upper ball seat or sealing rim 50 to facilitate supplying a small quantity of external air thereto and gradual release of the metering ball 42 from its sealing engagement with the upper sealing seat or rim 50. Once the metering ball 42 sealingly engages with the upper sealing seat or rim 50, the flow of additional product to be dispensed is discontinued. Thereafter, depression of the actuator 60 is discontinued while the surface tension of the product to be dispensed normally maintains engagement between the metering ball 42 and the upper ball seat or sealing rim 50. Over the course of a few minutes or so, external air is permitted to flow into and along the micro groove(s), channel(s) or vent(s) 68, formed along the length of the conventional coupling 52 and at least a portion of the upper ball seat or sealing rim 50, and assist with gradually breaking the surface tension and thereby releasing the metering ball 42 from its sealing engagement with the upper ball sealing or sealing rim 50. Thereafter, the metering ball 42 gradually moves or drops, through the product, contained within the meter chamber 19, back into sealing engagement with the lower ball sealing or sealing rim 44. Further details concerning the other features of the micro groove(s), channel(s) or vent(s) 68 will be provided with respect to FIGS. 26-26B which are discussed below.

The metering valve 40 of the present invention is different from metering valves according to the prior art where the metering device 42 is the only component within the valve stem 7. There are no complicated components or springs, but instead the sealing of the lower portion of the valve stem 7 is achieved by the sealing ring 31 positioned below the lower ball seat or sealing rim 44. The sealing ring 31 is located within an annular groove, which is formed in the valve stem 7 closely adjacent, but vertically below, the at least one radial bore(s) 21. The lower perimeter edge 26 of the valve housing 3 has a concave curvature 70 which is located to mate and sealingly engage with the sealing ring 31, when the valve stem 7, is in its normally closed position, as shown in FIG. 8.

As also shown in FIG. 8, prior to an initial priming of the valve, the metering ball 42 is located in its normal rest position in engagement with the lower ball seat or sealing rim 44. The metering chamber 19 of the valve stem 7, located between the upper and the lower ball seats or sealing rims 44, 50, is completely empty. In this closed position, the sealing ring 31 is in sealing engagement against the concave curvature 70 of the lower edge 26 of the valve housing 3 and prevents the product to be dispensed from communicating with the at least one radial bore(s) 21. In order to initially fill the metering chamber 19, the actuator 60 is at least partially depressed in order to move the valve stem 7 vertically downward. This causes the sealing ring 31 to move vertically downward away from and out of sealing engagement with the concave curvature 70 of the lower edge 26 to facilitate establishing communication between the product to be dispensed within the container and the radial bores 21, as shown in FIG. 9.

Figure 9:
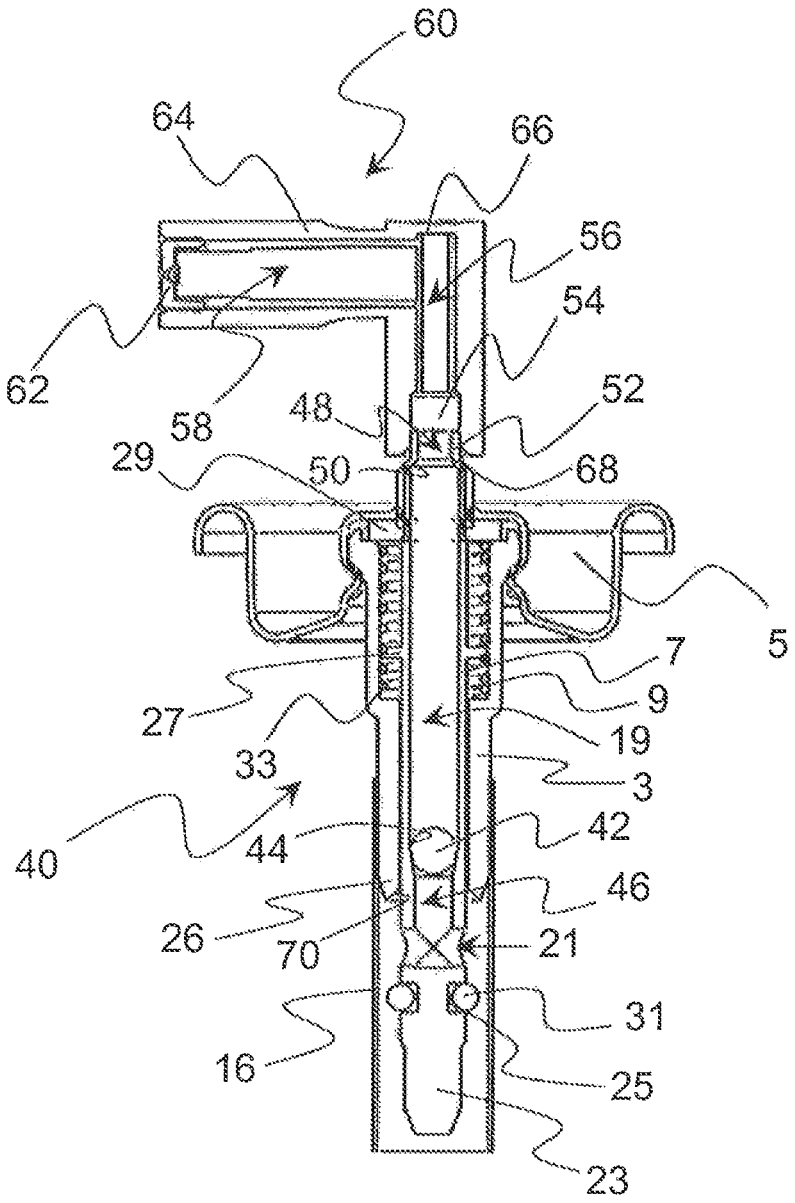
FIG. 9 is a diagrammatic cross sectional view of the third embodiment of the metering valve in an initially actuated position.
Figure 10:
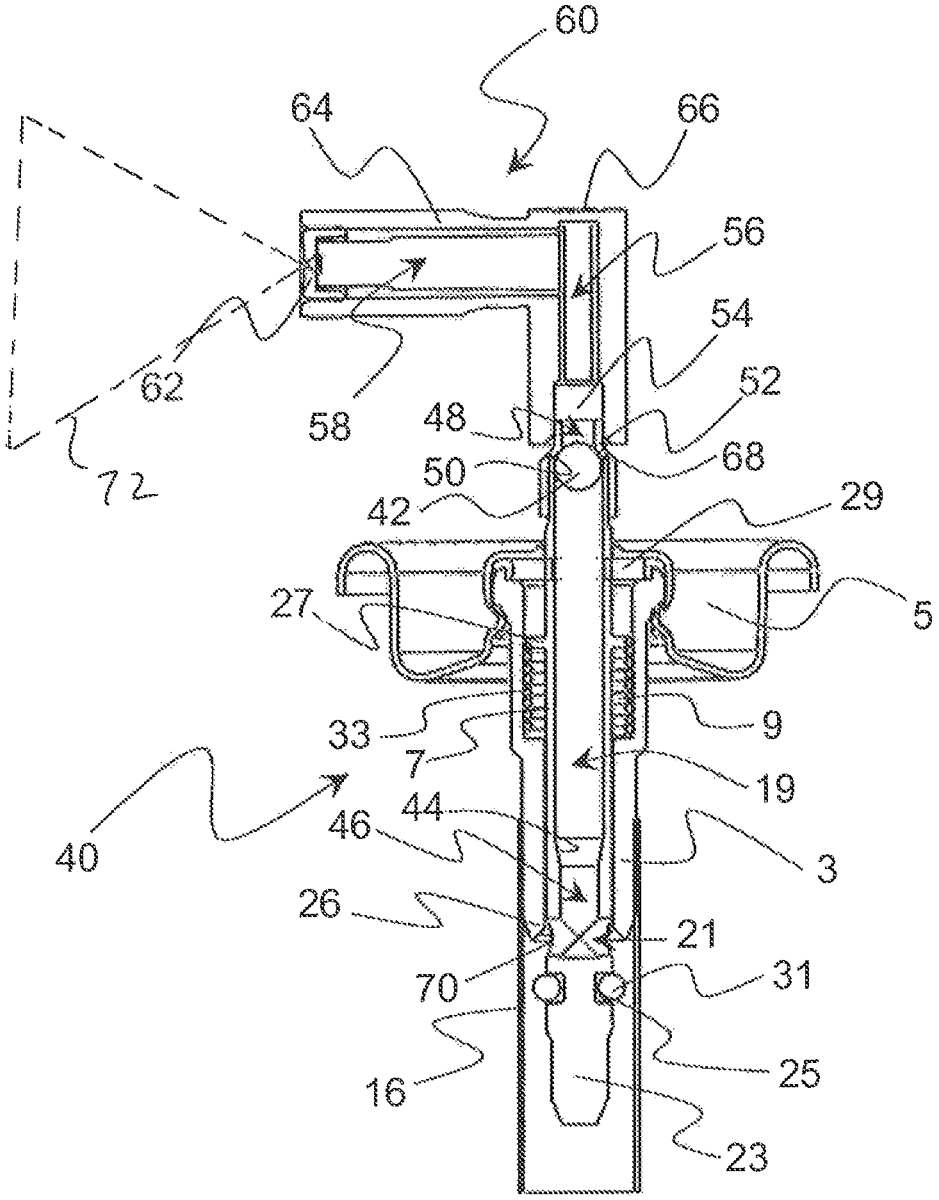
FIG. 10 is a diagrammatic cross sectional view of the third embodiment of the metering valve in an opened actuated position with the ball engaging with an upper valve seat to prevent further flow through the metering chamber.

Once this occurs, the product then immediately flows in through the at least one radial bore(s) 21 and in the inlet orifice of passage 46, as shown in FIG. 9. As product flows through the inlet passage 46, the product to be dispensed engages with a vertically lower surface of the ball 42 and rapidly forces the ball 42 out of engagement with the lower ball seat or sealing rim 44 and toward the upper ball seat or sealing rim 50. As the ball 42 moves vertically upward toward the upper ball seat or sealing rim 50, the product to be dispensed flows into and fills the metering chamber 19 of the valve stem 7. The product to be dispensed continues forcing the ball 42 through the metering chamber 19 until the ball 42 engages and abuts against the upper ball seat or sealing rim 50. The metering chamber 19 is then filled with the product to be dispensed, as shown in FIG. 10, and the valve begins to close.

During this initial priming of the valve 40, as described above, the metering chamber 19 is now completely filled with the product to be dispensed, however, no product has yet been dispensed through the nozzle of the actuator 60 because the valve stem 7 was initially empty and required initial priming of the metering chamber 19 in order to prime/fill the same. After completion of this initial priming step, the ball 42 still remains in abutting engagement against the upper ball seat or sealing rim 50 so as to prevent the flow of any product to be dispensed past this seal.

Figure 11:
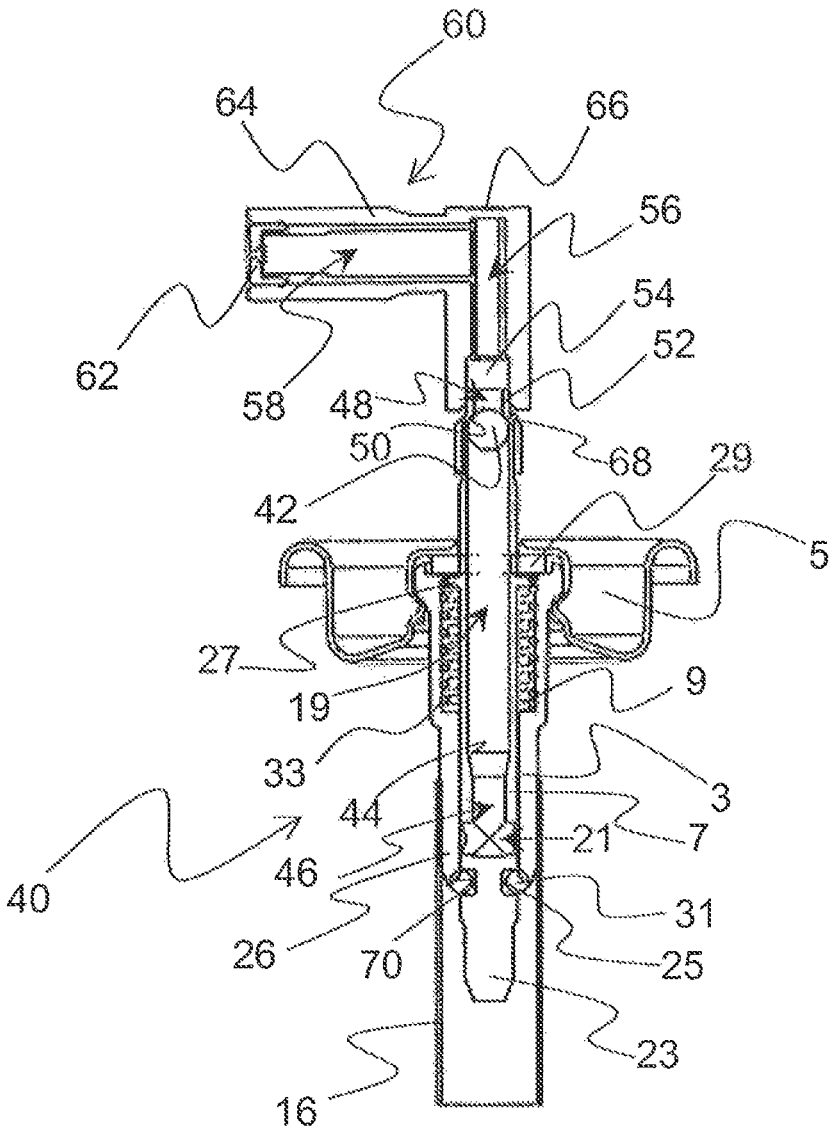
FIG. 11 is a diagrammatic cross sectional view of the third embodiment of the metering valve in a closed position with the ball still in engagement with the upper valve seat.
Figure 12:
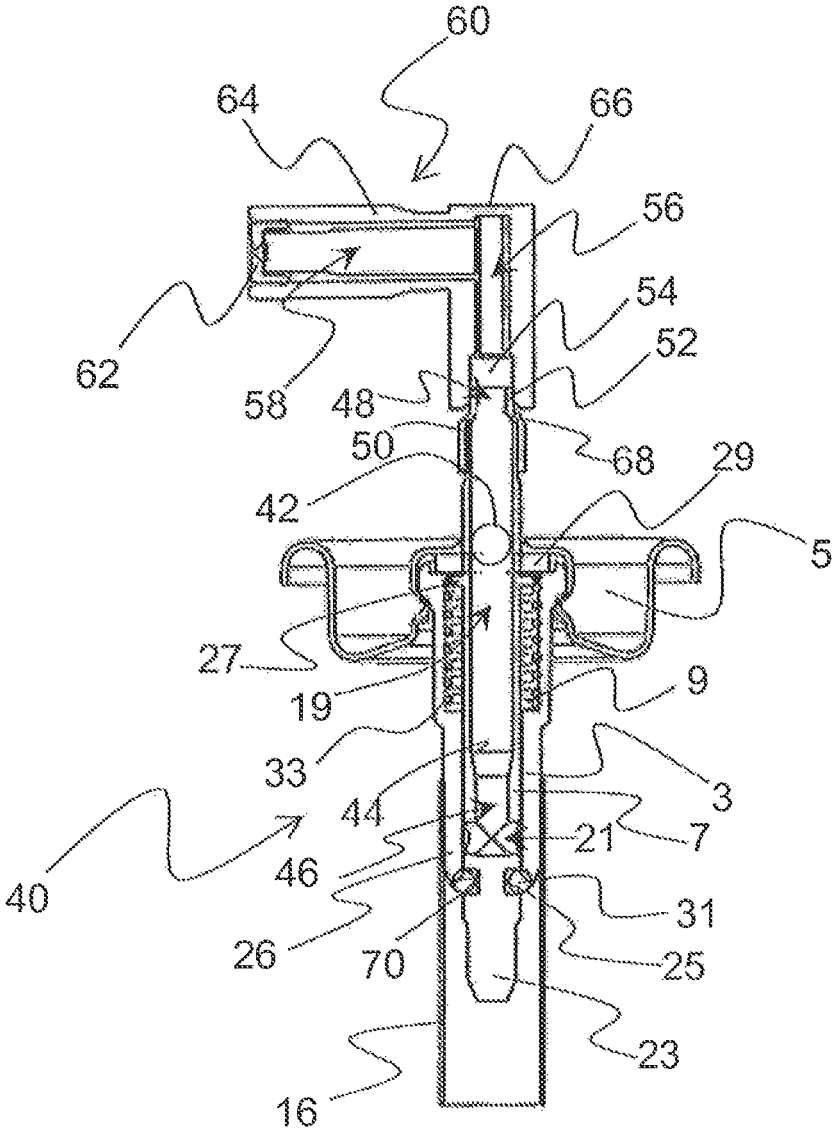
FIG. 12 is a diagrammatic cross sectional view of the third embodiment of the metering valve in the closed position with the ball moving from the upper valve seat toward the lower valve seat.
Figure 13:
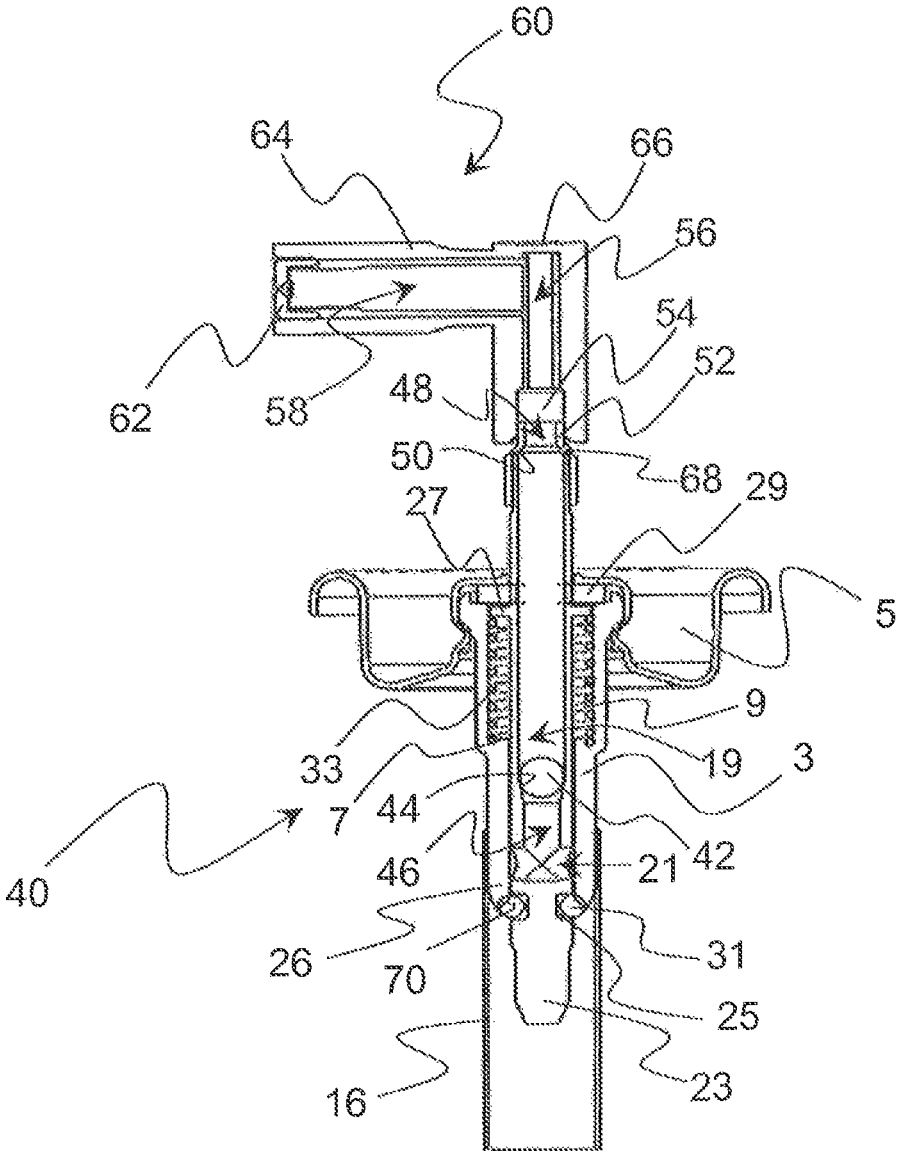
FIG. 13 is a diagrammatic cross sectional view of the third embodiment of the metering valve of the present invention in a closed unactuated position with the ball in engagement with the lower valve seat.

Next, the depression pressure of the actuator 60 is then removed so that the spring 33 biases the valve back into its closed position thereby preventing the flow of product to be dispensed into the at least one radial bore(s) 21. That is, the sealing ring 31 of the valve stem 7 is again brought back into sealing engagement with the concave curvature 70 of the lower perimeter edge 26 to prevent the flow of product to be dispensed into the at least one radial bore(s) 21, as shown in FIG. 11. The ball 42 is then permitted to be gradually released from its sealing engagement with the upper ball seat or sealing rim 50, due to surface tension, by external air. The external air is permitted to flow into and along the micro groove(s), channel(s) or vent(s) 68, formed along the length of the conventional coupling 52 and at least a portion of the upper ball seat or sealing rim 50, and gradually break the surface tension, thereby releasing the metering ball 42 from its sealing engagement with the upper ball sealing or sealing rim 50, as shown in FIG. 12. The ball 43 eventually rolls or falls through the product filled metering chamber 19, due to gravity, back into sealing engagement with the lower ball seat or sealing rim 44, as shown in FIG. 13. Once the ball 42 is located in this position, the ball 42 eventually again rests and seals against the lower sealing rim 44, as shown in FIG. 13.

When the ball 42 is in the position shown in FIG. 13, the metered valve 40 is now primed and ready to commence dispensing product. By depressing the actuation area 66, the actuator 60 is again at least partially depressed and moves the valve stem 7 vertically downward. This ensures that the sealing ring 31 moves vertically downward away from and out of sealing engagement with the concave curvature 70 of the lower edge 26 and facilitates communication between the product to be dispensed and the at least one radial bore(s) 21. Once this occurs, the product then immediately flows in through the at least one radial bore(s) 21 and the inlet passage 46, as shown in FIG. 9. As product flows through the inlet passage 46, the product engages with the ball 42 and forces the ball 42 out of sealing engagement with the lower ball seat or sealing rim 44 and toward the upper ball seat or sealing rim 50. As the ball 42 moves toward the upper ball seat or sealing rim 50, the product which is located within the metering chamber 19, between a vertically upper surface of the ball 42 and the upper ball seat or sealing rim 50, is forced out through the outlet orifice 48. The product is then forced into the first and the second passages 56, 58 of the actuator 60 and out through the discharge nozzle 62 in a desired spray pattern 72, as generally indicated by the dashed lines in FIG. 10.

The product to be dispensed continues forcing the ball 42 along the metering chamber 19 and again fills the metering chamber 19, for a subsequent dispensing cycle, until the ball 42 engages with and abuts against the upper ball seat or sealing rim 50, as shown in FIG. 11. As soon as this occurs, a pre-determined quantity of product to be dispensed will be dispensed from the actuator 60. Next, the ball 42 is then permitted to be gradually released from its sealing engagement with the upper ball seat or sealing rim 50. This sealing engagement is typically maintained by the surface tension of the product to be dispensed. Eventually, the ball 42 will roll or fall, due to gravity, through the product filled metering chamber 19, as shown in FIG. 12, back into sealing engagement with the lower ball seat or sealing rim 44, as shown in FIG. 13. Once the ball 42 is located in this position, the ball 42 eventually again seals against the lower sealing rim 44 and is thereby ready for a subsequent dispensing cycle.

Turning now to FIGS. 14-19, another embodiment of the present invention will now be described in detail. As this additional embodiment is quite similar to the embodiment of FIGS. 8-13, similar or like elements are given the same reference numerals.

According to this embodiment, the metering valve 40 is accommodated within the actuator 60, instead of the valve stem 7. Typically, the vertically upper most portion of the valve stem 7 is matingly received by and engages with a lower inlet passage 74 of the actuator 60 so that the outlet orifice 48, of the valve stem 7, is axially aligned with a vertical first passage 56 formed in the actuator 60. The product to be dispensed may be dispensed from the actuator 60, according to this embodiment, in a substantially horizontal discharge pattern. As shown, a second passage 58 is directly interconnected with the first passage 56. The second passage 58 communicates with actuator outlet 76 which accommodates a conventional discharge nozzle 62 and facilitates dispensing of the product to be dispensed as a desired aerosol mist, for example. As with the previous embodiment, an actuation or depression area 66 is provided along a top surface of the actuator housing 64 in order to facilitate depression of both the actuator 60 and the valve stem 7 in order to actuate the metered valve 40.

As shown in the drawings, second passage 58 includes a conical or tapered upper ball seat or sealing rim 50, located adjacent the discharge nozzle 62 of the actuator 60. The metering ball 42 has a slightly smaller diameter than the diameter of the metering chamber 19, it is undersized by 0.002-0.010 mm. This permits the metering ball 42 to move to and fro, along the metering chamber 19, and dispense a pre-determined quantity of product to be dispensed, while also facilitating return of the metering ball 42, as discussed below in further detail, back toward the opposite end of the metering chamber 19.

According to this embodiment, the second passage 58 extends completely through the end wall 78 of the actuator 60 and along a substantial portion of the length of the actuator 60 to a location closely adjacent an outlet chamber of the actuator 60. An opening 80, which is formed in the end wall 78 of the actuator 60, communicates directly with the external environment. A plug member 82 is received within and sealingly engages and closes the opening 80 formed in the end wall 78 of the actuator 60. The plug member 82 typically has an interference fit with the opening 80 so as to form a fluid tight seal when engaged therewith. An inwardly facing surface of the plug member 82 supports a post 84 and a free end of the post forms a stop surface or rim 44 which prevents further downward travel or movement of the metering ball 42 within the metering chamber 19. That is, the free end of the post 84 forms the lower ball seat or rim 44 which prevents further downward travel of the metering ball 42 within the second passage 58.

It is to be appreciated that the plug member 82 may alternatively comprise a cylindrical plug (not shown) which has a central aperture therein which extends longitudinally through the cylindrical plug and receives either a slidable or a rotatable post member (not shown), without departing from the spirit and scope of the present invention. The central aperture and the post member may both be threaded so that rotation of the post member, within the central aperture and relative to the cylindrical plug, in a first direction gradually moves the stop surface or rim 44 of the post member toward the tapered upper ball seat or sealing rim 50 while rotation of the post member, within the central aperture and relative to the cylindrical plug, in an opposite second direction, moves the stop surface or rim 44 of the post member away from the tapered upper ball seat or sealing rim 50. Such adjustment of the free end of the post relative to the cylindrical plug, i.e., the stop surface or rim 44 of the metering ball 42, thereby facilitates adjustment of the dispensing volume of the metering chamber 19.

Alternatively, the post member may be slidable relative to the central aperture and the cylindrical plug. Movement of the post member (not shown), within the central aperture, in a first direction moves the stop surface or rim 44 of the post member toward the tapered upper ball seat or sealing rim 50, while movement of the post member, within the central aperture, in an opposite second direction moves the stop surface or rim 44 of the post member away from the tapered upper ball seat or sealing rim 50. Such movement of the stop surface or rim 44 of the post member, in turn, varies the dispensing volume of the metering chamber 19.

As shown, the second passage 58 is inclined and typically forms an angle of between about 100 degrees and 175 degrees with the first passage 56 and the valve stem 7. More preferably, the second passage 58 forms an angle of between about 110 degrees and 130 degrees with the first passage 56 and the valve stem 7. The inclination of the second passage 58 must be sufficient sloped in order to assist with gradually returning the ball 42 back into engagement, due to gravity, with the lower ball seat or rim 44 once the valve closes.

As with the previous embodiment, an inwardly facing surface of the upper ball seat or sealing rim 50 is provided with at least one, or possibly more, micro groove(s), channel(s) or vent(s) 68 which extend along the length of the upper ball seat or sealing rim 50. The at least one, or possibly more, micro groove(s), channel(s) or vent(s) 68 (only diagrammatically shown) permits external air to flow into and along the micro groove(s), channel(s) or vent(s) 68 toward the upper ball seat or sealing rim 50 and facilitates gradual release of the metering ball 42 from its sealing engagement with the upper sealing seat or rim 50. Once the metering ball 42 sealingly engages with the upper sealing seat or rim 50, the flow of additional product to be dispensed from the metering chamber 19 is discontinued.

Thereafter, depression of the actuator 60 is eliminated while the internal pressure and the surface tension of the product to be dispensed normally maintains engagement between the metering ball 42 and the upper ball seat or sealing rim 50. Over the course of a few minutes or so, external air is permitted to flow into and along the at least one, or possibly more, micro groove(s), channel(s) or vent(s) 68 toward the upper ball seat or sealing rim 50. Such external air gradually breaks the surface tension and thereby releases the metering ball 42 from its sealing engagement with the upper ball sealing or sealing rim 50. Thereafter, the metering ball 42 gradually fall, moves or rolls, through the product contained within the meter chamber 19, back into engagement with the lower ball seat or rim 44.

At least one radial bore(s) 21 is formed in a lower portion of the valve stem 7. When the valve is in its closed position as shown in FIG. 14, the at least one radial bore(s) 21 is sealed engaged by the gasket 90 so as to prevent any product to be dispensed from flowing into the at least one radial bore(s) 21 and through the valve stem 7 toward the actuator 60.

Figure 14:
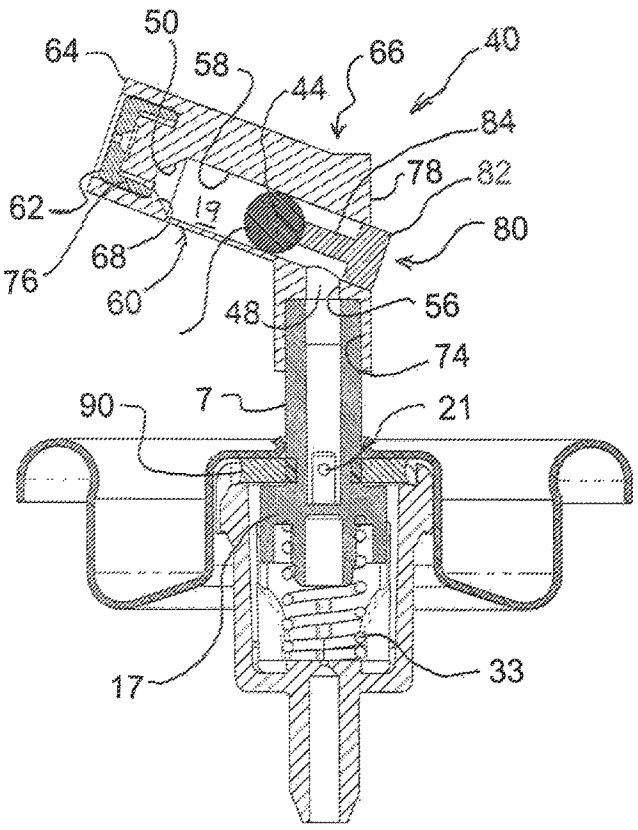
FIG. 14 is a diagrammatic cross sectional view of a fourth embodiment of the metering valve in a normally closed, unactuated position.

As shown in FIG. 14, prior to an initial priming of the valve, the metering ball 42 is located in its normal rest position in engagement with the lower ball seat or rim 44. The metering chamber 19 of the actuator 60, located between the upper ball seat or sealing rim 50 and the lower ball seat or rim 44, is completely empty. In this closed position, the at least one radial bore(s) 21 is sealed by the gasket 90 and thereby prevents the product to be dispensed from communicating with the at least one radial bore(s) 21. In order to initially fill the metering chamber 19, the actuator 60 is at least partially depressed in order to move the valve stem 7 vertically downward so that the at least one radial bore(s) 21 moves and is no longer sealed by the gasket 90. Such movement facilitates establishing communication between the product to be dispensed and the at least radial bore(s) 21, as shown in FIG. 15.

Figure 15:
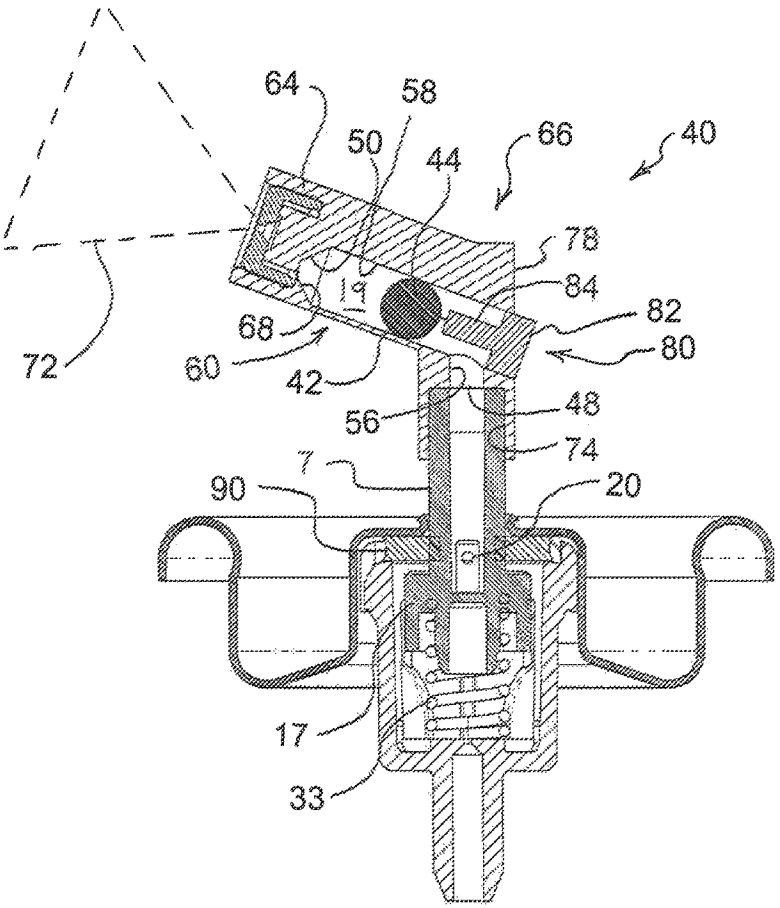
FIG. 15 is a diagrammatic cross sectional view of the fourth embodiment of the metering valve in an initially actuated position.
Figure 16:
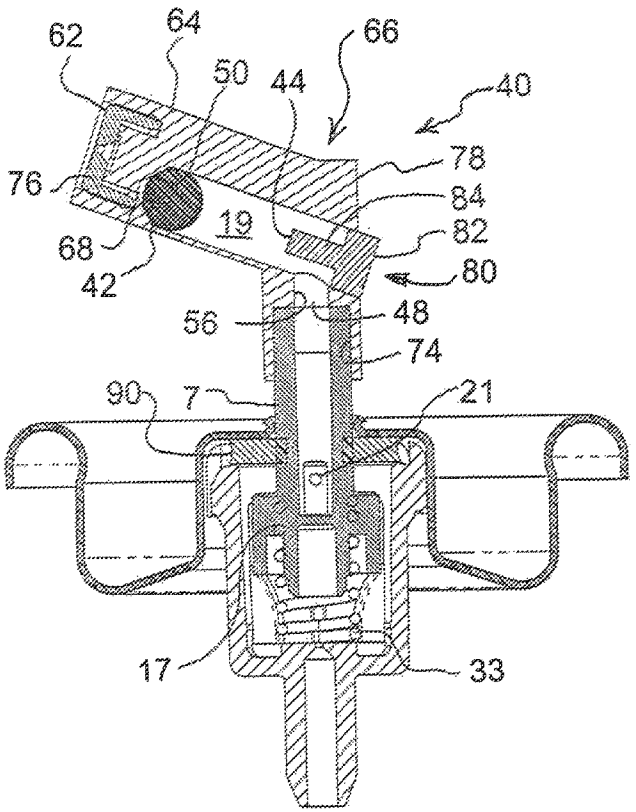
FIG. 16 is a diagrammatic cross sectional view of the fourth embodiment of the metering valve in the opened, actuated position with the ball engaging with an upper valve seat to prevent further flow through the metering chamber.

Once this occurs, the product then immediately flows in through the at least one radial bore(s) 21 and in the inlet passage, as generally shown in FIG. 15. As product flows through the inlet passage, the product to be dispensed engages with a vertically lower surface of the ball 42 and forces the ball 42 out of engagement with the lower ball seat or rim 44 and toward the upper ball seat or sealing rim 50. As the ball 42 moves toward the upper ball seat or sealing rim 50, the product to be dispensed flows into and commences filling the metering chamber 19 of the actuator 60. The product to be dispensed continues forcing the ball 42 along and through the metering chamber 19 until the ball 42 eventually engages and abuts against the upper ball seat or sealing rim 50. As a result of such movement, the metering chamber 19 is then completely filled with the product to be dispensed, as shown in FIG. 16. Once this occurs, thereafter, the valve can now be closed.

Following initially priming of the valve 40, as described above, the metering chamber 19 is now completely filled with the product to be dispensed, however, no product has yet been dispensed through the nozzle 62 of the actuator 60 because the metering chamber 19 was initially empty and required priming thereof. After completion of this initial priming step, the ball 42 still remains in abutting engagement against the upper ball seat or sealing rim 50, typically due to surface tension of the product to be dispensed, so as to prevent the flow of any product to be dispensed past this seal.

Figure 19:
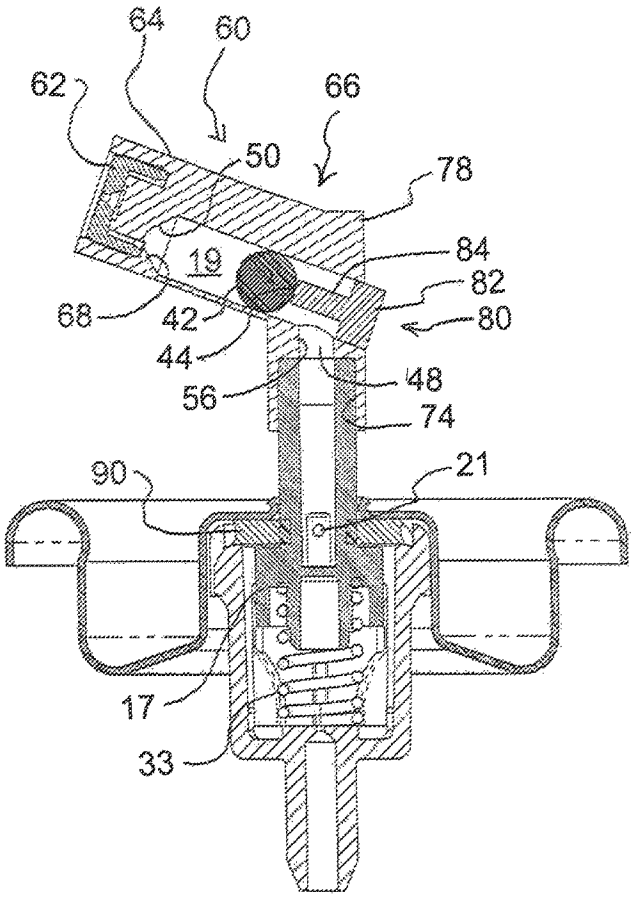
FIG. 19 is a cross sectional view of the fourth embodiment of the metering valve of the present invention in a closed unactuated position with the ball in engagement with the lower valve seat.
Figure 18:
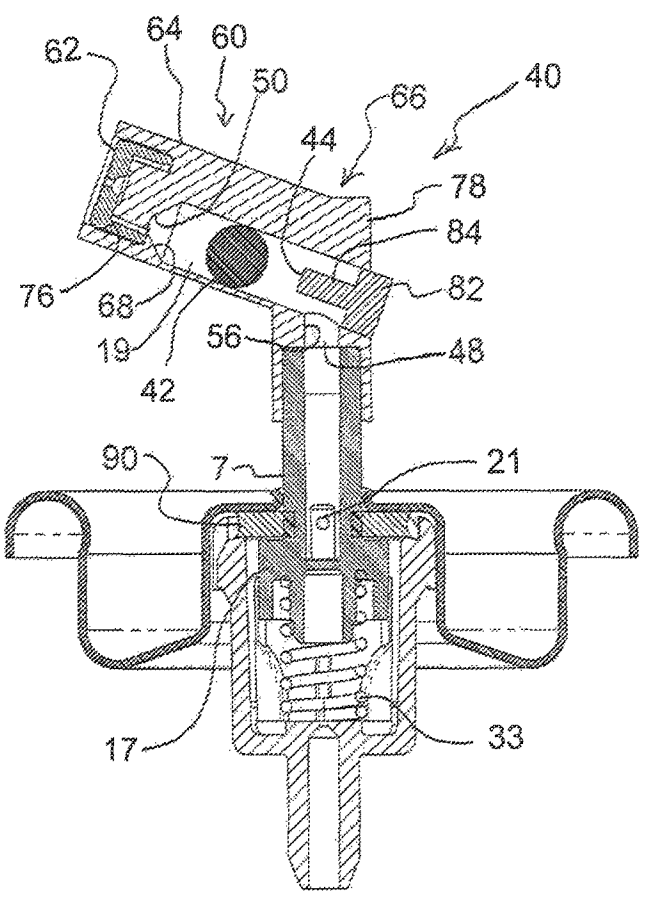
FIG. 18 is a diagrammatic cross sectional view of the fourth embodiment of the metering valve in the closed position with the ball gradually moving from the upper valve seat toward the lower valve seat.
Figure 17:
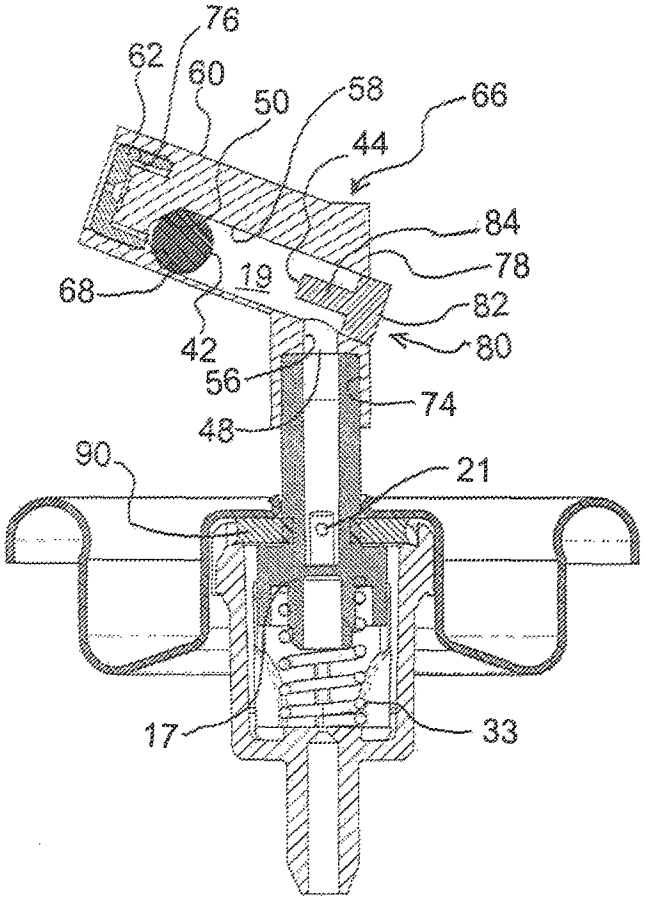
FIG. 17 is a diagrammatic cross sectional view of the fourth embodiment of the metering valve in a closed position with the ball still in engagement with the upper valve seat.

Next, the depression pressure of the actuator 60 is then removed or eliminated so that the spring 33 can bias the valve body 17 back into its normally closed position, thereby preventing the flow of any additional product to be dispensed into the at least one radial bore(s) 21, i.e., the at least one radial bore(s) 21 of the valve stem 7 is again sealingly engaged with the gasket 90 so as to prevent the flow of product to be dispensed into the at least one radial bore(s) 21, as shown in FIG. 17. The ball 42 is then permitted to be gradually released from its sealing engagement with the upper ball seat or sealing rim 50 by external air which flows in through the nozzle 62 and the actuator outlet 76 of the actuator 60 toward the upper ball seat or sealing rim 50. External air eventually flows along the at least one, or possibly more, micro groove(s), channel(s) or vent(s) 68 provided along a surface of upper ball seat or sealing rim 50 and breaks the surface tension of the product to be dispensed and thereby release the metering ball 42 from its sealing engagement with the upper ball sealing or sealing rim 50. As shown in FIG. 18, the ball 42 eventually and gradually falls, moves or rolls, due to gravity, through the product contained within the metering chamber 19 back into engagement with the lower ball seat or rim 44, as shown in FIG. 19. Once the ball 42 is located in this position, the ball 42 eventually again rests against the ball seat or rim 44.

When the ball 42 is in the position shown in FIG. 19, the metered valve 40 is now completely primed and ready to commence dispensing product. By depressing the actuation area 66, the actuator 60 is again at least partially depressed and moves the at least one radial bore(s) 21 of the valve stem 7 out of sealing engagement with the gasket 90 so as to facilitate communication between the product to be dispensed and the at least one radial bore(s) 21. Once this occurs, the product then immediately flows in through the at least one radial bore(s) 21 and the inlet passage, as shown in FIG. 15. As product flows through the inlet passage, the product travels along the valve stem 7, exits though the outlet orifice 48 and into the first passage 56. The product then flows through the first passage 56 and into the second passage 58 where the product forces the ball 42 out of engagement with the lower ball seat or rim 44 and toward the upper ball seat or sealing rim 50. As the ball 42 moves toward the upper ball seat or sealing rim 50, the product which is located in the metering chamber 19, between a front surface of the ball 42 and the upper ball seat or sealing rim 50, is forced out through the outlet chamber 76 and the discharge nozzle 62 of the actuator 60 in a desired spray pattern 72, generally indicated by the dashed lines in FIG. 15.

The product to be dispensed continues forcing the ball 42 along the metering chamber 19 until the ball 42 engages with and abuts against the upper ball seat or sealing rim 50, as shown in FIG. 16, and again fills the metering chamber 19, for a subsequent dispensing cycle. As soon as this occurs, a pre-determined quantity of product to be dispensed, from the metering chamber 19, was dispensed by the nozzle 62 of the actuator 60. Next, the ball 42 is then permitted to be gradually released from its sealing engagement with the upper ball seat or sealing rim 50, typically maintained by the surface tension of the product to be dispensed. Eventually the ball 42 falls, moves or rolls, due to gravity, as shown in FIG. 18, through the product which is contained within the metering chamber 19 and back into engagement with the lower ball seat or rim 44, as shown in FIG. 19. Once the ball 42 is located in this position, the ball 42 is again ready for a subsequent dispensing cycle.

Turning now to FIGS. 20-25, another embodiment of the present invention will now be described in detail. As this additional embodiment is quite similar to the embodiment of FIGS. 8-13, similar or like elements are given the same reference numerals.

According this embodiment, the valve is a female valve and the metering device 40 is accommodated within a portion of a male valve stem 86 which is releasably engageable with a top recess 88 formed within an upper surface of the valve body 17. A top portion of the valve housing 3 engages with a gasket 90 and a mounting cup 5, via crimping process, to secure the valve housing 3 and the gasket 90 to the mounting cup 5. An internal portion of the valve housing 3 defines a cavity which accommodates a spring 92 which controls dynamic movement of the valve body 17 with respect to the valve housing 3. The spring normally biases the valve body 17 away from a base surface of the cavity into a closed, sealing position in which a perimeter lip 94 of an upper surface of the valve body 17 engages with a lower surface of the gasket 90 and forms a fluid tight perimeter seal therebetween so as to prevent the flow of product through the valve.

A lower portion of the valve housing 3 is configured so as to engage with and retain a dip tube, a product bag, etc., or some other component, generally designated as element 16, which assists with supplying the product to be dispensed into the cavity of the valve. As noted above, a vertically lower portion of the male valve stem 86 is captively received and retained within the recess 88 formed in the upper surface of the valve body for securing the male valve stem 86 to the valve body 17, e.g., typically by an interference or friction fit. A lower side wall of the male valve stem 86 has at least one stem orifice 96 formed therein which permits the product to be dispensed to flow from the cavity defined by the valve housing 3 in through the stem orifice 96, into the male valve stem 86, and toward the metering chamber 19. Such flow occurs when the valve is actuated and the perimeter lip 94 of the valve body 17 is sufficiently spaced from the gasket 90 so as to permit product flow through the valve. As these and other features and components of a female valve are conventional and well known in the art, a further detailed discussion concerning the same is not provided.

Figure 20:
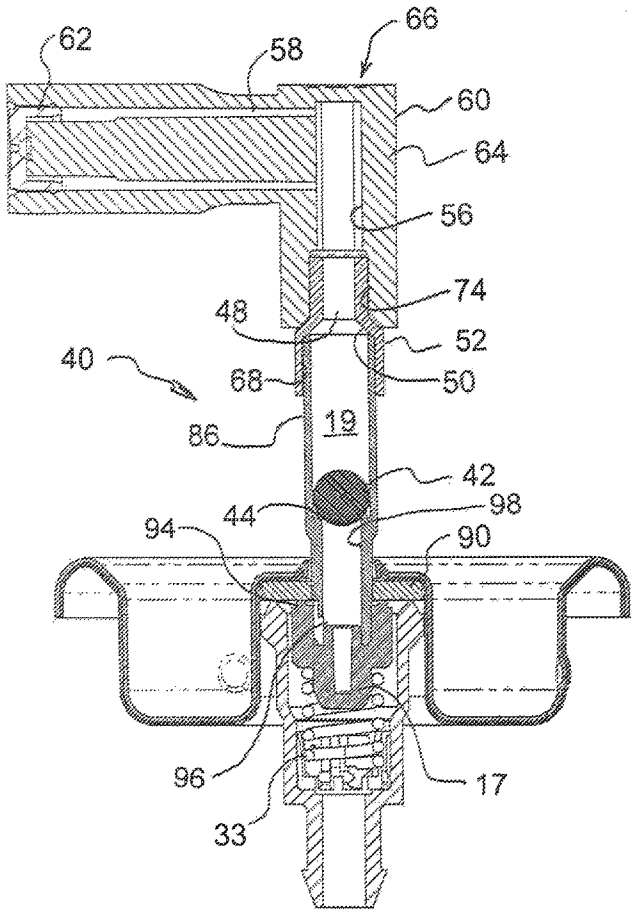
FIG. 20 is a diagrammatic cross sectional view of a fifth embodiment of the metering valve in a normally closed, unactuated position, but primed for dispensing product to be dispensed.

With reference now to FIG. 20, the metering valve 40 comprises a movable ball 42, or possibly a slidable piston or some other member, located within the male valve stem 86. The metering valve 40 includes a lower ball seat or rim 44, which transitions from the slightly larger diameter of the metering chamber 19 into the slightly smaller diameter of a supply passage 98 formed in a lower portion of the male valve stem 86.

A conventional coupling 52, or some other fitting, facilitates coupling/interconnection of the upper free end of the male valve stem 86 with an inlet passage 74 of an actuator 60. Typically, the vertically upper most portion of the male valve stem 86 is matingly received by a first end of the conventional coupling 52 while the opposite vertically upper most end of the conventional coupling 52 is received by and snugly fits within the inlet passage 74 of the actuator 60. This ensures that the outlet orifice 48 is axially aligned with a vertical first passage 56 formed in the actuator 60.

The product to be dispensed may be dispensed from the actuator 60 either radially, as shown, via a substantially horizontal second passageway 58 which connects the first passage 56 with a discharge nozzle 62 of the actuator 60 and facilitates dispensing of the product as an aerosol mist, for example. Alternatively, it may be dispensed from the actuator 60 substantially vertically (not shown) via the second passageway 58 which is substantially vertically aligned with, e.g., substantially a continuation of, the first passage 56. An actuation or depression area 66 may be provided along a top surface of the actuator housing 64 in order to facilitate depression of both the actuator 60 and the male valve stem 86, the valve body and actuation of the metered valve 40.

The conventional coupling 52 has a conical or tapered upper ball seat or sealing rim 50, located adjacent the outlet orifice 48, and the outlet orifice 48 has a smaller diameter than a diameter of the metering chamber 19. The metering ball 42 has a slightly smaller diameter than the diameter of the metering chamber 19 so as to permit the metering ball 42 to dispense a pre-determined quantity of product to be dispensed, while also facilitating return of the metering ball 42 back to its normal rest position, as discussed below in further detail.

Figure 21:
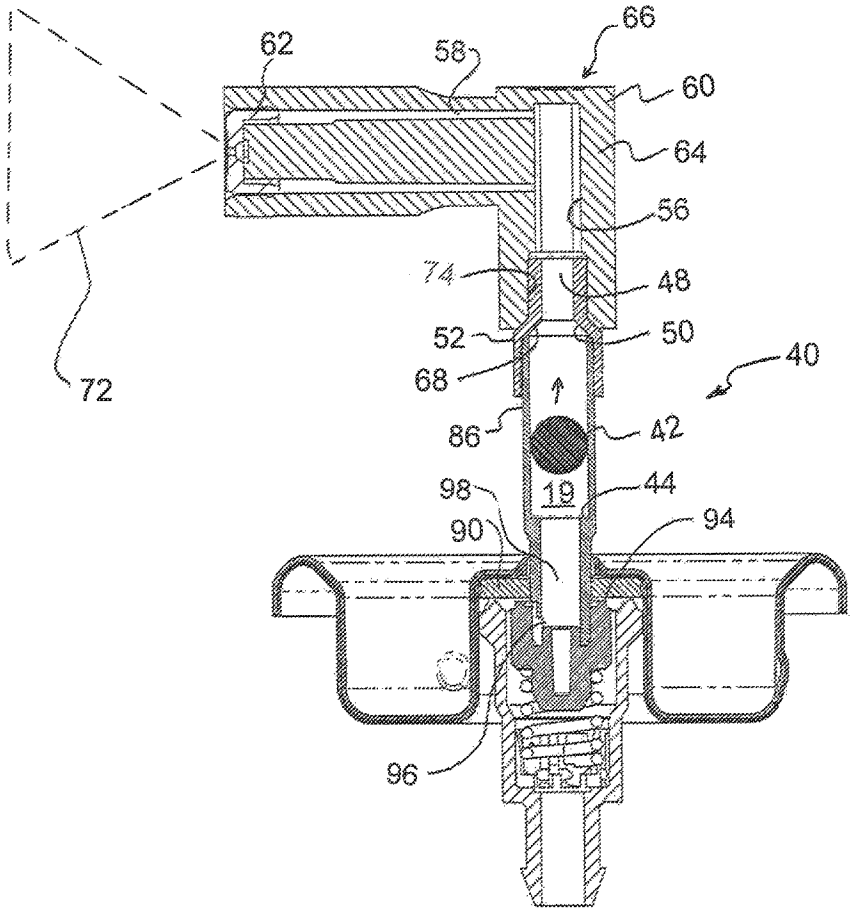
FIG. 21 is a diagrammatic cross sectional view of the fifth embodiment of the metering valve in an initially actuated position.

As shown in FIG. 20, prior to an initial priming of the valve, the metering ball 42 is located in its normal rest position in engagement with the lower ball seat or rim 44. The metering chamber 19 of the male valve stem 86, located between the upper ball seat or sealing rim 50 and the lower ball seat or rim 44, is completely empty. In this closed position, the perimeter lip 94 is in sealing engagement against the gasket 90 and prevents the product to be dispensed from flowing from the cavity into the stem orifice 96. In order to initially fill the metering chamber 19, the actuator 60 is at least partially depressed in order to move the valve body 17 vertically downward so that the perimeter lip 94 is sufficiently spaced from the gasket 90 and thereby establishes communication between the cavity and into the stem orifice 96 so that the product to be dispensed can commence flowing, as shown in FIG. 21.

Figure 22:
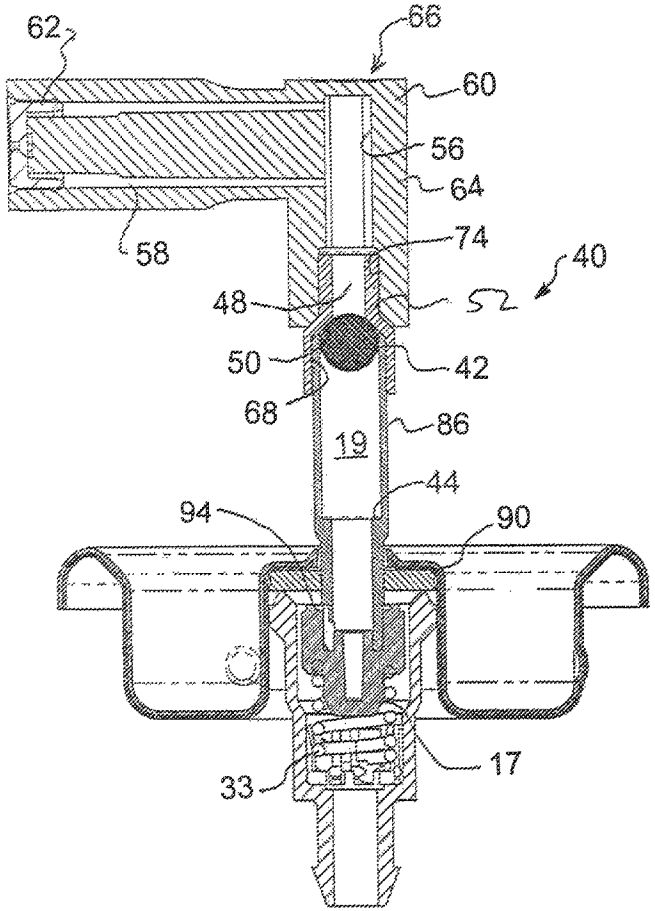
FIG. 22 is a diagrammatic cross sectional view of the fifth embodiment of the metering valve in an opened actuated position with the ball engaging with an upper valve seat to prevent further flow through the metering chamber.
Figure 23:
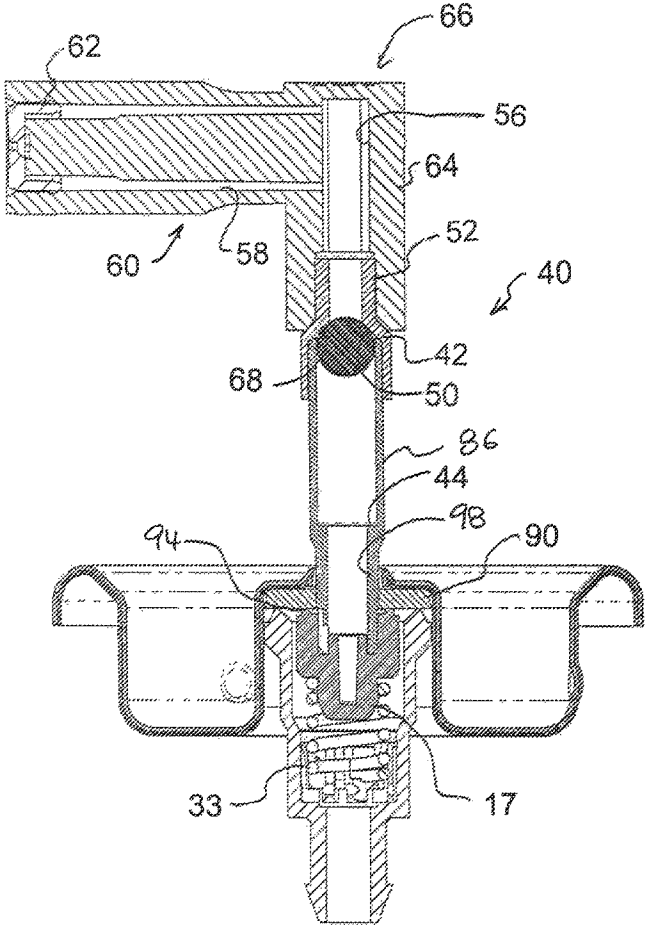
FIG. 23 is a diagrammatic cross sectional view of the fifth embodiment of the metering valve in a closed position with the ball still in engagement with the upper valve seat.

Once this occurs, the product then immediately flows in through the stem orifice 96 and along the supply passage 98 of the male valve stem 86. As the product flows through the supply passage 98, the product to be dispensed engages with a vertically lower surface of the ball 42 and forces the ball 42 out of engagement with the lower ball seat or rim 44 and toward the upper ball seat or sealing rim 50, as shown in FIG. 21. As the ball 42 moves toward the upper ball seat or sealing rim 50, the product to be dispensed flows into and fills the metering chamber 19. The product to be dispensed continues forcing the ball 42 along and through the metering chamber 19 until the ball 42 eventually engages and abuts against the upper ball seat or sealing rim 50. As a result of such movement, the metering chamber 19 is then filled with the product to be dispensed, as shown in FIG. 22. Once this occurs, thereafter, the valve can be closed so that the perimeter lip 94 is again located in sealing engagement with the gasket 90 and thereby prevents the product to be dispensed from flowing out of the cavity into the stem orifice 96, as shown in FIG. 23.

Figure 25:
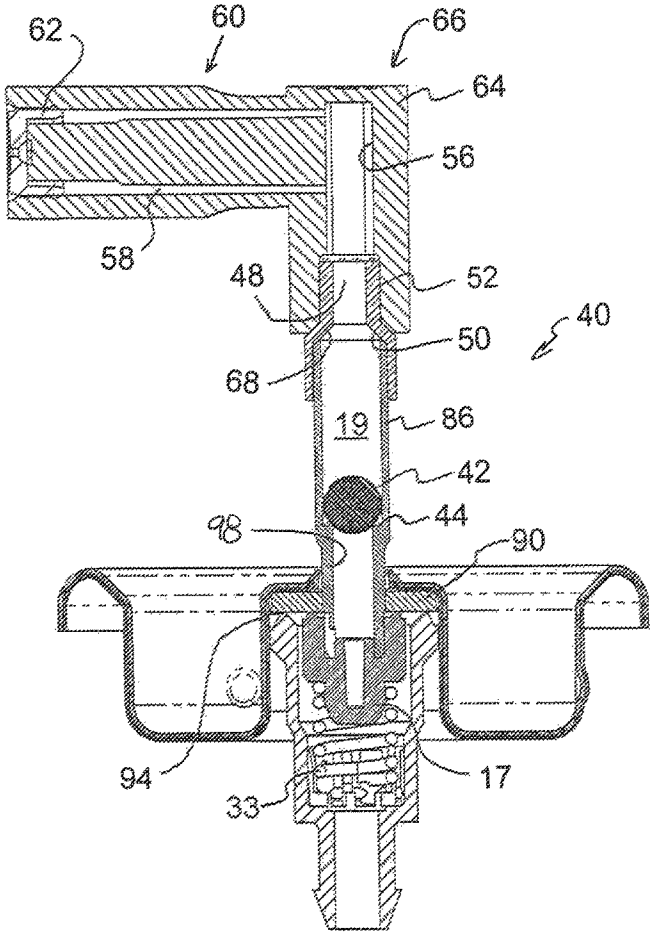
FIG. 25 is a cross sectional view of the fifth embodiment of the metering valve of the present invention in a closed unactuated position with the ball in engagement with the lower valve seat, but primed for dispensing product to be dispensed.
Figure 24:
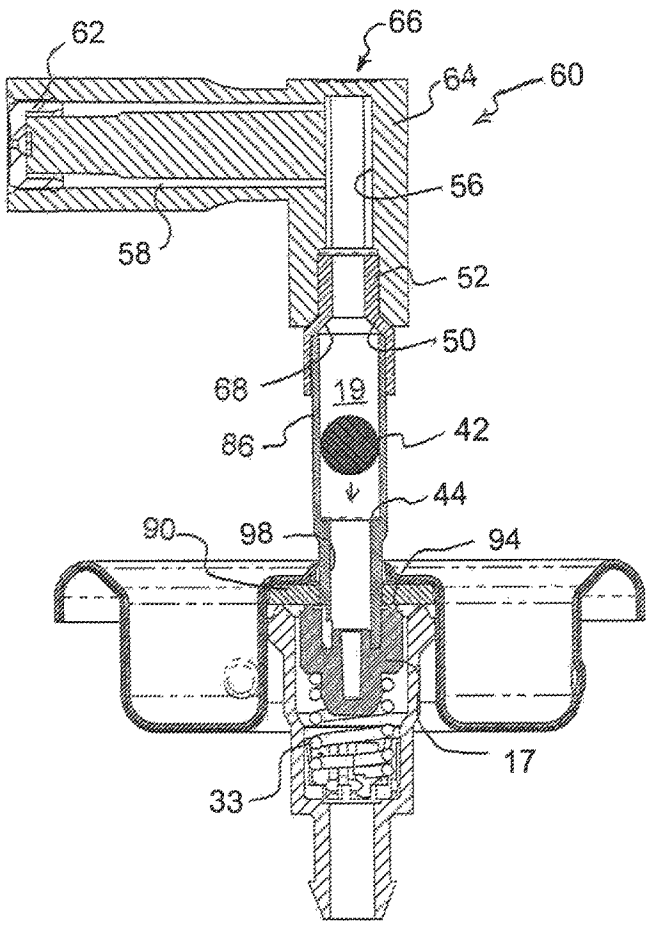
FIG. 24 is a diagrammatic cross sectional view of the fifth embodiment of the metering valve in the closed position with the ball moving from the upper valve seat toward the lower valve seat.

Once the metering ball 42 sealingly engages with the upper sealing seat or rim 50, the flow of additional product to be dispensed is automatically discontinued. Thereafter, depression of the actuator 60 is discontinued while the surface tension, of the product to be dispensed, normally maintains the sealing engagement between the metering ball 42 and the upper ball seat or sealing rim 50. Over the course of a few minutes or so, external air is permitted to flow from the external environment into and along the at least one micro groove(s), channel(s) or vent(s) 68 to the upper ball seat or sealing rim 50 and gradually break the surface tension and thereby release the metering ball 42 from its sealing engagement with the upper ball sealing or sealing rim 50. Thereafter, the metering ball 42 gradually falls, moves or rolls, through the product contained within the meter chamber 19, as shown in FIG. 24, back into sealing engagement with the lower ball seat or rim 44, as shown in FIG. 25.

As shown in FIG. 20, prior to an initial priming of the valve, the metering ball 42 is located in its normal rest position in engagement with the lower ball seat or rim 44. The metering chamber 19, located between the upper and the lower ball seats or rims 44, 50, is completely empty. In this closed position, the perimeter lip 94 is sealingly engaged with the gasket 90 and prevents the product to be dispensed from communicating with the stem orifice 96. In order to initially fill the metering chamber 19, the actuator 60 is at least partially depressed in order to move the male valve stem 86 and the valve body vertically downward. This ensures that the perimeter lip 94 correspondingly moves vertically downward away from and out of sealing engagement with the gasket 90 to facilitate establishing communication between the product to be dispensed and the stem orifice 96, as shown in FIG. 21.

Once this occurs, the product then immediately flow in through the at least one stem orifice 96 and into the supply passage 98 of the male valve stem 86, as shown in FIGS. 21 and 22. As product flows from the cavity through the at least one stem orifice 96 and the supply passage 98, the product to be dispensed engages with a vertically lower surface of the ball 42 and forces the ball 42 out of engagement with the lower ball seat or rim 44 and toward the upper ball seat or sealing rim 50, as shown in FIG. 21. As the ball 42 moves vertically upward toward the upper ball seat or sealing rim 50, the product to be dispensed flows into and fills the metering chamber 19 of the male valve stem 86. The product to be dispensed continues forcing the ball 42 through the metering chamber 19 until the ball 42 engages and abuts against the upper ball seat or sealing rim 50, as shown in FIG. 22, so that the metering chamber 19 is then filled with the product to be dispensed and the valve can then be closed.

After such initial priming of the valve 40, as described above, the metering chamber 19 is now completely filled with the product to be dispensed, however, no product has yet been dispensed through the nozzle 62 of the actuator 60 because the male valve stem 86 was initially empty and required priming of the metering chamber 19. After completion of this initial priming step, the metering ball 42 still remains in abutting engagement against the upper ball seat or sealing rim 50 so as to prevent the flow of any product to be dispensed past this seal.

Next, the depression pressure of the actuator 60 is then removed or eliminated so that the spring 33 biases the valve body 17 back into its normally closed position thereby preventing the flow of additional product to be dispensed from the cavity into the at least one stem orifice 96, i.e., the perimeter lip 94 of the valve body 17 is again brought into sealing engagement with the gasket 90 to prevent the flow of product to be dispensed into the at least one stem orifice 96, as shown in FIG. 23. The ball 42 is then permitted to be gradually released from its sealing engagement with the upper ball seat or sealing rim 50 by external air which flows into and along the one or more micro grooves, channels or vents 68 and the external air eventually breaks the surface tension and thereby releasing the metering ball 42 from its sealing engagement with the upper ball sealing or sealing rim 50. The ball 42 eventually falls, moves or rolls through the product filled metering chamber 19, due to gravity as generally shown in FIG. 24, back into engagement with the lower ball seat or rim 44, as shown in FIG. 25. Once the ball 42 is located in this position, the ball 42 eventually again rests against the lower ball seat or rim 44 and is ready for another dispensing cycle.

Once the ball 42 is in the position shown in FIG. 25, the metered valve 40 is now completely primed and ready to commence dispensing product. By depressing the actuation area 66, the actuator 60 is again at least partially depressed and moves the valve body vertically downward so that the perimeter lip 94 moves vertically downward away from and out of sealing engagement with the gasket 90 so as to permit product flow from the cavity into the at least one stem orifice 96 and facilitate communication between the product to be dispensed and the supply passage 98 of the male valve stem 86. Once this occurs, the product then immediately flows in through the at least one stem orifice 96 and the supply passage 98 of the male valve stem 86, as shown in FIG. 21. As the product flows through the stem orifice 96 of the male valve stem 86, the product engages with the ball 42 and forces the ball 42 out of sealing engagement with the lower ball seat or rim 44 and toward the upper ball seat or sealing rim 50. As the ball 42 moves toward the upper ball seat or sealing rim 50, the product which is located in the metering chamber 19, between a vertically upper surface of the ball 42 and the upper ball seat or sealing rim 50, is displaced and forced out through the outlet orifice 48. The product is then forced out through the first and the second passages 56, 58 of the actuator 60 and through the discharge nozzle 62 for dispensing in a desired spray pattern 72, as generally indicated by the dashed lines in FIG. 21.

As the product to be dispensed forces the ball 42 along the metering chamber 19, additional product to be dispensed fills the metering chamber 19, for a subsequent dispensing cycle, until the ball 42 engages with and abuts against the upper ball seat or sealing rim 50, as shown in FIG. 22. As soon as this occurs, a pre-determined quantity of product to be dispensed will be dispensed from the actuator 60. Next, depression of the actuator 60 is removed or eliminated and the metering ball 42 is then permitted to be gradually released from its sealing engagement with the upper ball seat or sealing rim 50, by external air which is permitted to flow to the at least one, or possibly more, micro groove(s), channel(s) or vent(s) 68 and break the surface tension and thereby releasing the metering ball 42 from its sealing engagement with the upper ball sealing or sealing rim 50. The metering ball 42 eventually falls, moves or rolls, due to gravity, through the product filled metering chamber 19 back into engagement with the lower ball seat or rim 44, as shown in FIG. 24. Once the metering ball 42 is located in this position, the metering ball 42 again rests against the lower ball seat or rim 44, as shown in FIG. 25, and is again ready for a subsequent dispensing cycle.

Figure 26:
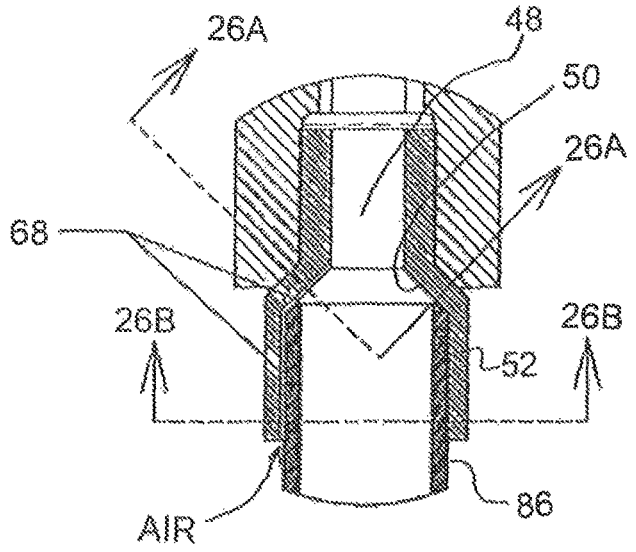
FIG. 26 is an enlarged cross sectional view of area M of FIG. 20, showing a micro groove, channel or vent.
Figure 26A:
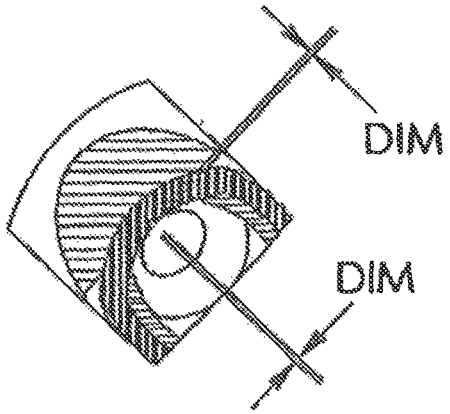
FIG. 26A is a cross sectional view along section line 26A-26A of FIG. 26.
Figure 26B:
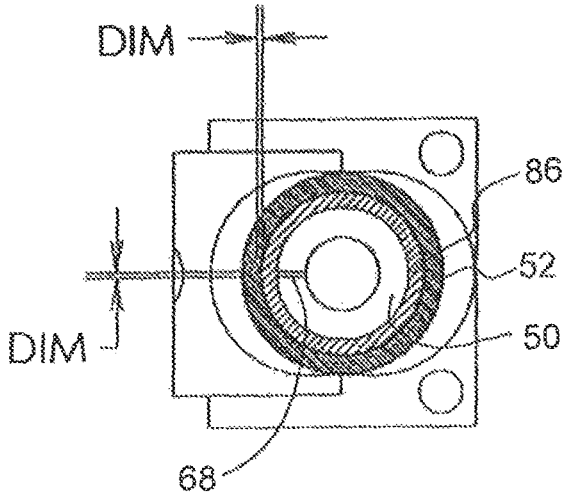
FIG. 26B is a cross sectional view along section line 26B-26B of FIG. 26.

As shown in FIGS. 26, 26A and 26B, the conventional coupling 52 has at least one, and possibly more, micro groove(s), channel(s) or vent(s) 68 formed in an inwardly facing surface thereof. The at least one, and possibly more, micro groove(s), channel(s) or vent(s) 68 extends continuously and uninterrupted along the inwardly facing surface, from a lower bottom edge of the conventional coupling 52 to and along at least a major portion of the upper ball seat or sealing rim 50. Each micro groove(s), channel(s) or vent(s) 68 typically has a height of between 0.002 inches and 0.010 of an inch, preferably about 0.005 of an inch, and a width of between 0.002 inches and 0.010 of an inch, preferably about 0.005 of an inch. Each micro groove(s), channel(s) or vent(s) 68 has a cross-sectional flow area which is designed to permit external air to flow therealong to the upper ball seat or sealing rim 50 and eventually assist with breaking the surface tension seal achieved by the product to be dispensed, between the metering ball 42 and the upper ball seat or sealing ring rim 50. Such cross-sectional flow area is also designed to be sufficiently small so as to prevent any significant amount of the product to be dispensed from flowing out through the micro groove(s), channel(s) or vent(s) 68.

The metering chamber 19 typically has a length of between 1.023±0.100 inches and between 0.334±0.100 inches and a diameter of between 0.140 inches and between 0.110 inches, preferably about 0.127 inches. The metering chamber 19 typically has a volume of between 50 and 100 micrometers, depending upon the particular application. It is to be appreciated that the length and/or the diameter of the metering chamber 19 are designed or selected so as to accommodate the desired predetermined quantity of product to be dispensed during each dispensing cycle of the metering ball 42.

Since certain changes may be made in the above described improved continuous dispensing actuator assembly, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A dispensing valve for use in a pressurized aerosol application, the dispensing valve comprising:

a mounting cup supporting a gasket, and an opening extending through both the mounting cup and the gasket to facilitate receiving a valve stem;

a valve housing defining a cavity, the valve housing being captively retained by the mounting cup, with the gasket being sandwiched between the valve housing and the mounting cup;

a lower portion of the valve housing comprising a housing passage which facilitates communication between the product to be dispensed and the cavity of the valve housing;

a movable valve stem having a centrally located product passage extending therethrough from an inlet end and an outlet end of the valve stem, the product passage having a constant diameter from the inlet end to the outlet end, and a stop being provided on an exterior surface of the valve stem, between the inlet end and the outlet end;

a circumferential channel being provided in the exterior surface of the valve stem, adjacent the inlet end thereof, and a sealing ring being received within the circumferential channel;

a spring being accommodated within the cavity, and the spring biasing the stop of the valve stem against the gasket so that the sealing ring engages with the housing passage and prevents product from flowing through the dispensing valve; and at least one radial orifice being formed in a sidewall of the valve stem, between the spring and the sealing ring, for dispensing of product at a desired flow rate through the dispensing valve, when the dispensing valve is actuated.

2. The dispensing valve according to claim 1, wherein the radial orifice is a bore having a substantially circular shape.

3. The dispensing valve according to claim 1, wherein the bore has a diameter of between about 0.04-0.15 inches (1.02 mm-3.81 mm).

4. The dispensing valve according to claim 1, wherein the bore has a diameter of between about 0.08-0.12 inches (2.03 mm-3.05 mm).

5. The dispensing valve according to claim 1, wherein the radial orifice is a polygon bore which becomes progressively exposed to the product to be dispensed and thus permits an increase in relative product flow the greater the valve stem is depressed by a user.

6. A dispensing valve for use in a pressurized aerosol application, the dispensing valve comprising:

a mounting cup supporting a gasket, and an opening extending through both the mounting cup and the gasket to facilitate receiving a valve stem;

a valve housing defining a cavity, the valve housing being captively retained by the mounting cup, with the gasket being sandwiched between the valve housing and the mounting cup;

a lower portion of the valve housing comprising a housing passage which facilitates communication between the product to be dispensed and the cavity of the valve housing;

a cylindrical valve stem having a centrally located product passage extending therethrough from an inlet end and an outlet end of the valve stem, the product passage having a constant diameter from the inlet end to the outlet end, and a stop being provided on an exterior surface of the cylindrical valve stem, between the inlet end and the outlet end;

a circumferential channel being provided in the exterior surface of the valve stem, adjacent the inlet end thereof, and a sealing ring being received within the circumferential channel;

only a single spring being accommodated within the cavity, and the single spring extending between a bottom surface of the valve housing and a first surface of the stop so as to bias a second surface of the stop of the valve stem against the gasket so that the sealing ring engages with the housing passage and prevents product from flowing through the dispensing valve; and at least one radial orifice being formed in a sidewall of the valve stem, between the single spring and the sealing ring, for dispensing of product at a desired flow rate through the dispensing valve, when the dispensing valve is actuated.

7. The dispensing valve according to claim 6, wherein the radial orifice is a bore having a substantially circular shape.

8. The dispensing valve according to claim 6, wherein the bore has a diameter of between about 0.04-0.15 inches (1.02 mm-3.81 mm).

9. The dispensing valve according to claim 6, wherein the bore has a diameter of between about 0.08-0.12 inches (2.03 mm-3.05 mm).

10. The dispensing valve according to claim 6, wherein the radial orifice is a polygon bore which becomes progressively exposed to the product to be dispersed and thus permits an increase in relative product flow the greater the valve stem is depressed by a user.

11. A dispensing valve for use in a pressurized aerosol application, the dispensing valve consisting of:

a mounting cup supporting a gasket, and an opening extending through both the mounting cup and the gasket to facilitate receiving a valve stem;

a valve housing defining a cavity, the valve housing being captively retained by the mounting cup, with the gasket being sandwiched between the valve housing and the mounting cup;

a lower portion of the valve housing comprising a housing passage which facilitates communication between the product to be dispensed and the cavity of the valve housing;

a valve stem having a centrally located product passage extending therethrough from an inlet end and an outlet end of the valve stem, the product passage having a constant diameter from the inlet end to the outlet end, a stop being provided on an exterior surface of the cylindrical valve stem, between the inlet end and the outlet end, and the exterior surface of the valve stem having a constant diameter except for the stop;

a circumferential channel being provided in the exterior surface of the valve stem, adjacent the inlet end thereof, and a sealing ring being received within the circumferential channel;

only a single spring, being accommodated within the cavity, and the single spring extending between a bottom surface of the valve housing and a first surface of the stop so as to bias a second surface of the stop of the valve stem against the gasket so that the sealing ring engages with the housing passage and prevents product from flowing through the dispensing valve;

at least one radial orifice being formed in a sidewall of the valve stem, between the single spring and the sealing ring, for dispensing of product at a desired flow rate through the dispensing valve, when the dispensing valve is actuated; and a cross sectional area of the at least one radial orifice being at least the same size as a cross sectional area of the product passage of the valve stem.

* * * * *